US011707163B2

(12) United States Patent
Masino

(10) Patent No.: US 11,707,163 B2
(45) Date of Patent: Jul. 25, 2023

(54) DISPENSERS AND RELATED DEVICES AND METHODS FOR MOUNTING DISPENSERS

(71) Applicant: Angelo Masino, Elmwood Park, NJ (US)

(72) Inventor: Angelo Masino, Elmwood Park, NJ (US)

( * ) Notice: Subject to any disclaimer, the term of this patent is extended or adjusted under 35 U.S.C. 154(b) by 0 days.

(21) Appl. No.: 17/346,572

(22) Filed: Jun. 14, 2021

(65) Prior Publication Data

US 2022/0395147 A1 Dec. 15, 2022

(51) Int. Cl.
*A47K 10/46* (2006.01)
*A47K 10/38* (2006.01)
*A47K 10/32* (2006.01)

(52) U.S. Cl.
CPC ..... *A47K 10/46* (2013.01); *A47K 10/3827* (2013.01); *A47K 2010/3266* (2013.01)

(58) Field of Classification Search
CPC ..... A47K 10/46; A47K 2010/3266; A47K 10/3827
USPC ..... 221/33, 34, 63, 102, 134, 45, 97; 206/233, 449; 242/598.5, 55, 55.53
See application file for complete search history.

(56) References Cited

U.S. PATENT DOCUMENTS 213,555 A * 3/1879 Evans ..... F41A 9/72 42/49.01
1,025,512 A * 5/1912 Craven ..... B65D 83/0011 222/390
1,451,775 A * 4/1923 Husch ..... A46B 9/045 15/176.1
2,711,226 A * 6/1955 Davis, Jr. ..... B04C 5/103 96/61
2,759,598 A * 8/1956 Tregilgas ..... B65D 21/083 206/537
2,813,289 A * 11/1957 Even ..... A45D 29/007 221/56
2,860,941 A * 11/1958 Fromwiller ..... G07F 11/04 62/464
2,960,259 A * 11/1960 Aveni ..... B65D 83/0436 221/229
3,001,645 A * 9/1961 Hernberg ..... B65D 5/48016 221/34
3,095,087 A * 6/1963 Yates ..... A47K 10/421 221/34
3,112,046 A * 11/1963 Szekely ..... B65D 83/0409 221/312 R
3,159,308 A * 12/1964 Passavanti ..... B65D 83/0409 221/289
3,162,322 A * 12/1964 Gilbertson ..... B65D 83/02 221/202
3,201,004 A * 8/1965 Plonski ..... A47J 47/01 222/294
3,221,928 A * 12/1965 Horn ..... A47K 10/421 221/56

(Continued)

FOREIGN PATENT DOCUMENTS

CN 102271564 A * 12/2011 ..... A47K 10/3818
GB 2439304 A * 12/2007 ..... A47K 10/3818

(Continued)

*Primary Examiner* — Rakesh Kumar
(74) *Attorney, Agent, or Firm* — Capitol Patent & Trademark Law Firm, PLLC

(57) ABSTRACT

Innovative mounting devices for innovative wipe dispensers are described.

23 Claims, 21 Drawing Sheets

(56) References Cited

U.S. PATENT DOCUMENTS 3,236,369 A * 2/1966 Moore ..... B65D 77/08 426/119
3,331,498 A * 7/1967 Davies ..... A47K 10/24 206/494
3,365,099 A * 1/1968 Mctaggart ..... A61J 7/04 206/499
3,567,085 A * 3/1971 Flores ..... B65D 81/266 224/604
3,706,394 A * 12/1972 Merz ..... B65D 83/0811 221/75
3,762,539 A * 10/1973 Kerr ..... B65D 83/0481 220/8
3,845,858 A * 11/1974 Jenkins ..... B65D 83/00 220/504
3,872,996 A * 3/1975 Dogliotti ..... B65D 47/0847 220/837
3,994,417 A * 11/1976 Boedecker ..... A47K 10/32 221/48
3,998,238 A * 12/1976 Nigro ..... G07D 1/08 221/297
4,051,977 A * 10/1977 Steinfeld ..... B65D 83/049 206/217
4,094,408 A * 6/1978 Ford ..... A61J 7/04 220/4.27
4,142,649 A * 3/1979 Forgey ..... B65D 83/02 222/97
4,171,753 A * 10/1979 Vreede ..... B65D 83/0418 221/229
4,173,281 A * 11/1979 Trought ..... A61F 2/1691 206/439
4,420,076 A * 12/1983 Beveridge ..... A61J 1/03 206/37
4,489,853 A * 12/1984 Korte ..... A61J 7/0076 221/187
4,560,086 A * 12/1985 Stol ..... G07F 11/44 D20/3
4,589,575 A * 5/1986 Rigberg ..... B65D 83/0418 221/269
4,782,946 A * 11/1988 Pollak ..... A45C 11/005 264/2.6
4,854,761 A * 8/1989 Smith ..... A45D 29/007 401/196
4,879,442 A * 11/1989 Giovine ..... B65D 83/0888 206/233
4,893,728 A * 1/1990 Jennings ..... B65D 47/283 222/499
4,903,860 A * 2/1990 Leopoldi ..... B65D 83/0481 222/522
4,919,302 A * 4/1990 McPherson ..... A47K 10/421 229/120.08
4,965,951 A * 10/1990 Miller ..... F41A 9/77 89/33.02
4,971,203 A * 11/1990 Weinstein ..... B65D 83/0481 206/536
4,984,709 A * 1/1991 Weinstein ..... B65D 83/0409 206/536
5,042,687 A * 8/1991 McKinley ..... A47G 29/00 221/45
5,054,612 A * 10/1991 Meyer, Jr. ..... B65D 83/0888 229/123.1
D322,215 S * 12/1991 Hunt ..... D9/733
D322,932 S * 1/1992 Hunt ..... D9/733
5,099,999 A * 3/1992 Balien ..... B65D 83/0481 221/152
5,129,545 A * 7/1992 Parks ..... B65D 83/0888 221/102
5,141,129 A * 8/1992 Jennings ..... B65D 50/061 206/536
5,141,171 A 8/1992 Yang
5,178,298 A * 1/1993 Allina ..... B65D 83/0418 221/229
5,191,995 A * 3/1993 McDonald ..... A63B 47/002 221/24
5,230,440 A * 7/1993 Kurokawa ..... B65D 83/0418 221/232
5,341,954 A * 8/1994 Smith ..... G07F 11/42 221/85
5,372,267 A * 12/1994 Hofmann ..... B65D 47/283 215/217
5,373,940 A * 12/1994 Hillelson ..... A45D 40/18 206/385
5,386,910 A * 2/1995 Liss ..... B65F 1/062 220/676
D360,790 S 8/1995 Landis
5,511,691 A * 4/1996 West, Jr. ..... A47F 1/08 221/45
5,520,171 A * 5/1996 David ..... F41A 9/77 89/33.02
5,570,808 A * 11/1996 Tassoni ..... B65D 83/0805 221/311
5,704,471 A * 1/1998 Yamada ..... B65D 83/0805 206/812
5,803,249 A * 9/1998 Harsanyi, Jr. ..... A47K 10/3818 206/812
5,839,605 A * 11/1998 Hadtke ..... A47F 1/065 312/43
5,944,219 A * 8/1999 Emoff ..... G09F 3/10 221/45
5,950,913 A * 9/1999 Rea ..... B65D 3/24 220/23.88
D414,636 S 10/1999 Wiese
6,004,054 A * 12/1999 Wei-Pin ..... A45D 40/06 401/78
D423,263 S 4/2000 King et al.
6,082,368 A * 7/2000 Brown ..... A23G 3/48 424/440
6,092,757 A * 7/2000 Leytem ..... B65H 35/0006 242/593
6,135,842 A * 10/2000 LaFata ..... A63H 33/28 446/16
6,279,776 B1 * 8/2001 Finkletaub ..... B65D 47/263 221/281
6,321,937 B1 * 11/2001 DeSimone ..... A47K 10/3818 221/45
6,371,296 B1 * 4/2002 Rumbough ..... A47K 10/185 206/459.1
6,439,386 B1 * 8/2002 Sauer ..... B65D 5/4208 221/45
6,523,717 B1 * 2/2003 Willemsen ..... A45D 40/18 221/307
6,554,156 B1 * 4/2003 Chong ..... A47K 10/3818 221/303
6,631,800 B1 * 10/2003 Keeven ..... G01P 5/02 222/548
6,648,172 B2 * 11/2003 Leighton ..... A47K 10/424 221/48
D511,090 S * 11/2005 Devine ..... D9/422
D511,917 S 11/2005 Borchardt
6,978,776 B2 * 12/2005 Hamilton ..... F41B 11/55 221/277
7,014,062 B2 * 3/2006 Parris ..... A47K 10/46 221/102
D522,785 S 6/2006 Brady
7,086,561 B2 * 8/2006 Bosanac ..... A63B 55/20 224/919
D541,088 S 4/2007 Nesci
7,204,389 B2 * 4/2007 Smith ..... B65D 43/0212
D565,968 S * 4/2008 Mantenuto ..... D9/734
7,357,274 B2 * 4/2008 Hewett ..... A47K 10/424 221/45
7,367,471 B1 * 5/2008 Ip ..... G07F 11/36 221/75
7,455,166 B2 * 11/2008 Seiffert ..... B65B 35/12 193/46
7,490,734 B2 * 2/2009 Carr ..... A47K 10/46 221/92
7,530,472 B2 5/2009 Bitowft et al.

(56) References Cited

U.S. PATENT DOCUMENTS 7,669,731 B2 * 3/2010 Hewett ..... A47K 10/424 221/48
D623,453 S 9/2010 Benedetti
8,006,860 B2 * 8/2011 Klein ..... B65D 85/60 206/800
8,359,816 B2 * 1/2013 Guschke ..... B65B 7/20 53/170
D687,650 S 8/2013 Wells et al.
8,523,011 B2 * 9/2013 Haas ..... B65D 83/0418 221/229
8,523,013 B2 * 9/2013 Sines ..... B65D 21/08 221/209
8,561,837 B2 * 10/2013 Giammanco ..... A47K 10/46 221/102
D702,965 S 4/2014 Ross
D718,953 S * 12/2014 Masino ..... D6/518
8,998,033 B2 * 4/2015 Huard ..... A47K 10/422 221/277
9,102,457 B2 * 8/2015 Parrish ..... B65G 11/063
9,708,117 B1 * 7/2017 Keuleers ..... B65D 83/04
9,764,888 B2 * 9/2017 Tiesberger ..... B65D 83/0409
9,968,228 B2 * 5/2018 Sellars ..... A47K 10/38
9,975,688 B2 * 5/2018 Benouali ..... B65D 51/26
10,342,396 B2 * 7/2019 Sellars ..... A47K 10/3818
10,646,021 B2 * 5/2020 Daifallah ..... A45D 40/28
10,647,500 B1 * 5/2020 Madden ..... A01K 27/008
10,683,137 B2 * 6/2020 Hawry ..... B65D 21/086
2002/0121451 A1 * 9/2002 Subramanian ..... B65D 83/0888 221/45
2003/0116582 A1 * 6/2003 Tosdale ..... A47K 10/3818 221/70
2003/0132239 A1 * 7/2003 Konig ..... B65D 83/0418 221/249
2003/0178436 A1 * 9/2003 Ashford ..... A47K 10/421 221/33
2003/0189059 A1 * 10/2003 May ..... A47K 10/421 221/34
2003/0234257 A1 * 12/2003 Tumlinson ..... B65D 83/0888 221/102
2006/0101564 A1 * 5/2006 Powdermaker ..... A61J 19/00 4/259
2006/0151521 A1 * 7/2006 Toker ..... A61J 7/0076 221/226
2006/0214048 A1 * 9/2006 Sucher ..... B65H 16/06 242/598.5
2006/0289554 A1 * 12/2006 Mitchell ..... B65D 83/0894 221/34
2006/0289557 A1 * 12/2006 Mitchell ..... B65D 83/0894 221/97
2006/0289558 A1 * 12/2006 Parker ..... A47K 10/46 221/97
2007/0000792 A1 * 1/2007 Newman ..... B65D 21/0204 206/5.1
2007/0045333 A1 * 3/2007 Mitchell ..... B65D 83/0888 221/34
2007/0267531 A1 * 11/2007 Petersen ..... B65D 83/0805 242/588.6
2007/0272694 A1 * 11/2007 May ..... B65D 83/08 220/495.07
2007/0289553 A1 * 12/2007 Jager ..... A01K 15/026 119/710
2008/0110922 A1 * 5/2008 Sines ..... B65D 83/0027 221/279
2008/0132438 A1 * 6/2008 Hoffman ..... A01N 33/12 15/97.1
2009/0057332 A1 * 3/2009 Arzola ..... B65D 25/52 221/102
2009/0223992 A1 * 9/2009 Lorenzati ..... A47K 10/421 221/34
2010/0126998 A1 * 5/2010 Wilson ..... B65D 51/28 220/495.07
2011/0079603 A1 * 4/2011 Gordon ..... A47K 10/3818 221/92
2011/0084089 A1 * 4/2011 Maccario ..... A47K 10/46 221/34
2011/0192862 A1 * 8/2011 Knudsen ..... A47K 10/3818 248/205.2
2013/0146501 A1 * 6/2013 Zusmanis ..... B65F 1/1638 221/102
2013/0228589 A1 * 9/2013 Nickerson ..... A47K 10/46 221/102
2013/0313258 A1 * 11/2013 Sines ..... B65D 83/0005 220/780
2014/0061199 A1 * 3/2014 Dalbec ..... B65D 51/24 53/471
2017/0233169 A1 * 8/2017 Keuleers ..... C11D 17/043 221/1
2017/0258041 A1 * 9/2017 Dadalto ..... A01K 5/0114
2020/0130921 A1 * 4/2020 Goyal ..... A47F 13/00
2020/0231367 A1 * 7/2020 Almond ..... A61L 12/086
2021/0063251 A1 * 3/2021 Gleadhill ..... G01K 11/12
2021/0137322 A1 * 5/2021 Mann ..... B65D 83/0835
2021/0315773 A1 * 10/2021 Siskov ..... B65D 83/04
2021/0321834 A1 * 10/2021 Jennings ..... A47K 10/421
2022/0395147 A1 * 12/2022 Masino ..... A47K 10/3827

FOREIGN PATENT DOCUMENTS

GB 2466658 A * 7/2010 ..... A47K 10/3818
WO WO-2006135563 A2 * 12/2006 ..... A47K 10/421
WO WO-2007144884 A2 * 12/2007 ..... B65D 83/0805
WO WO-2007148125 A2 * 12/2007 ..... A47K 10/3818
WO WO-2008038008 A2 * 4/2008 ..... B65F 1/0006

* cited by examiner

SECTION C–C

TOP

SIDE

BOTTOM

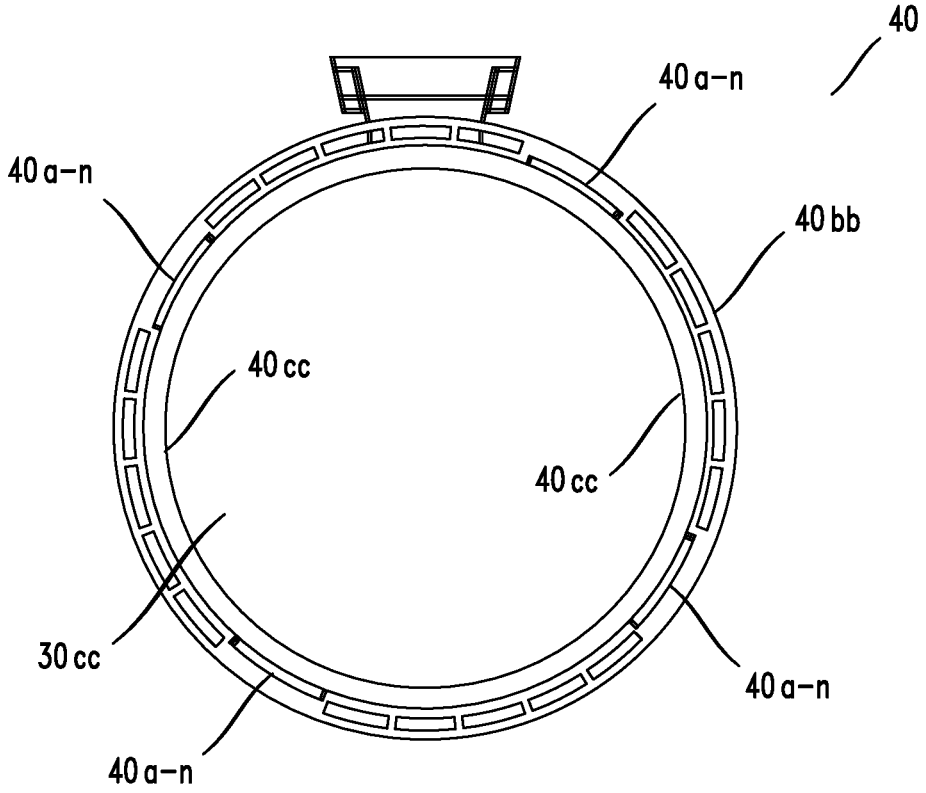
*FIG.* 6 B

DISPENSERS AND RELATED DEVICES AND METHODS FOR MOUNTING DISPENSERS

RELATED APPLICATIONS

The present application is related to U.S. Design Pat. D718,953S entitled "Sanitary Wipe Dispenser" (the "'D953 Patent") and U.S. Design Patent application No. 29/794, 533 filed Jun. 14, 2021 entitled "Wipe Dispenser". The present application incorporates by reference the entirety of the disclosures of the 'D953 Patent and Design Patent Application No. 29/794, 533 as if the 'D953 Patent and Design Patent Application No. 29/794, 533 were set forth in full herein.

INTRODUCTION

This section introduces aspects that may be helpful to facilitate a better understanding of the described invention(s). Accordingly, the statements in this section are to be read in this light and are not to be understood as admissions about what is, or what is not, in the prior art.

It is desirable to provide dispensers and related devices and methods for mounting dispensers that overcome the shortfalls of existing techniques.

SUMMARY

The inventor discloses various inventive dispensers and devices and related methods for mounting dispensers that overcome the shortfalls of existing techniques.

In one embodiment, an inventive dispenser may comprise: a wipe chamber component; a discard receptacle component; and a mounting device configured to at least fix the wipe chamber component and the discard receptacle component to a supporting structure capable of supporting the weight of the dispenser filled with unused wipes and as link to connect the wipe chamber component and discard receptacle component.

The composition of the wipe chamber component, discard receptacle component and mounting device comprises an opaque thermoplastic and amorphous polymer, for example.

As described herein, the wipe chamber component may be configured to receive, hold and dispense unused wipes and the discard receptacle component may be configured to receive, hold and discard used wipes. The mounting device may be configured to at least fix the wipe chamber component and the discard receptacle component to a supporting structure capable of supporting the weight of the dispenser filled with the unused wipes in the wipe chamber component and used wipes in the discard chamber component.

Further, the discard receptacle component may comprises a first aperture that has a diameter that allows used wipes to be placed into the receptacle component, where the shape of the first aperture may be circular or oval, or alternatively, may be funneled shaped. In addition, the discard receptacle component may comprise tabs positioned around the perimeter of the receptacle component, each of the tabs configured to be rotatably and slidably fit or inserted into a groove of the mounting device to connect and hold the receptacle component to the mounting device.

Still further, the exemplary inventive dispenser may comprise a cover configured to cover a second aperture of the discard receptacle component to prevent used wipes from falling into the wipe chamber component, for example. In one embodiment the cover may be a removable cover, for example.

Similarly, the wipe chamber component may comprises tabs configured to be rotatably and slidably fit or inserted into a groove of the mounting device to connect and hold the wipe chamber component to the mounting device.

Alternatively, instead of tabs, the wipe chamber component and the discard receptacle component may comprise respective one or more integral threads, where the respective threads are configured to be threadably rotated into threads of the mounting device to connect and hold the respective component to the mounting device. In an embodiment, each of the respective threads of each of the components may be threaded in the same direction (e.g., clockwise).

The wipe chamber component may comprise a removable wipe chamber interface element for regulating the dispensing of unused wipes from the wipe chamber, where the removable wipe chamber interface element may be composed of a thermoplastic elastomer material, for example. In more detail, the removable wipe chamber interface element may comprise a frictional aperture comprising frictional edge openings and a central frictional aperture to regulate the dispensing of unused wipes, where the frictional aperture may forms an "+" shape, for example. Further, the dimensions of the edges and central aperture are selected to frictionally dispense an unused wipe or wipe section from unused wipes held within the wipe chamber component.

The removable wipe chamber interface element may itself comprise one or more indentations, each of which is configured around a perimeter of the wipe chamber interface element and may be aligned with corresponding protrusions on an interior of a bottom surface of the wipe chamber component to fix the wipe chamber interface element over the interior of the bottom surface and to align a central frictional aperture of the wipe chamber interface element with an aperture on the bottom surface to allow wipes to be dispensed from the wipe chamber component.

Regarding the mounting device, it may comprise a curved element that further comprises one or more grooves, where each groove is located at a different position around an internal perimeter surface of the curved element and is configured to receive at least one tab of the discard receptacle component and at least one tab of the wipe chamber component. The mounting device may further comprise a bracket configured to be integrally molded to the curved element to support at least the weight of the curved element the wipe chamber component filled with unused wipes and the discard receptacle component filled with used wipes.

In an embodiment, the bracket may comprise one or more openings, each opening configured to receive a fastener therethrough to allow the bracket to be secured and/or fixed to a supporting structure. Alternatively, the bracket may comprise an adhesive surface or covering to fix the bracket to the supporting structure.

Yet further, the bracket may comprise one or more slots, each slot configured to receive a fastener therethrough.

In addition to inventive dispensers the inventor also discloses inventive mounting devices and related methods.

In one embodiment, an exemplary inventive mounting device for a dispenser may be configured to at least fix a wipe chamber component and a discard receptacle component of the dispenser to a supporting structure. Such a mounting device may comprise: a curved element that comprises one or more grooves, where each groove is located at a different position around an internal perimeter surface of the curved element and is configured to receive tabs of the discard receptacle component and tabs of the wipe chamber component; and a bracket configured to be integrally molded to the curved element to support at least the weight of the curved element, the wipe chamber component filled with unused wipes and the discard receptacle component filled with used wipes. The bracket may comprise one or more openings, each opening configured to receive a fastener therethrough to allow the bracket to be secured and/or fixed to the supporting structure, or, alternatively, may comprise an adhesive surface or covering to fix the bracket to a supporting structure. Yet further, the bracket may comprise one or more slots, each slot configured to receive a fastener therethrough.

DESCRIPTION OF THE DRAWINGS

FIGS. 6A and 6B depict different views of an alternative, inventive mounting device according to an embodiment of the invention.

DETAILED DESCRIPTION, WITH EXAMPLES

Figure 1A:
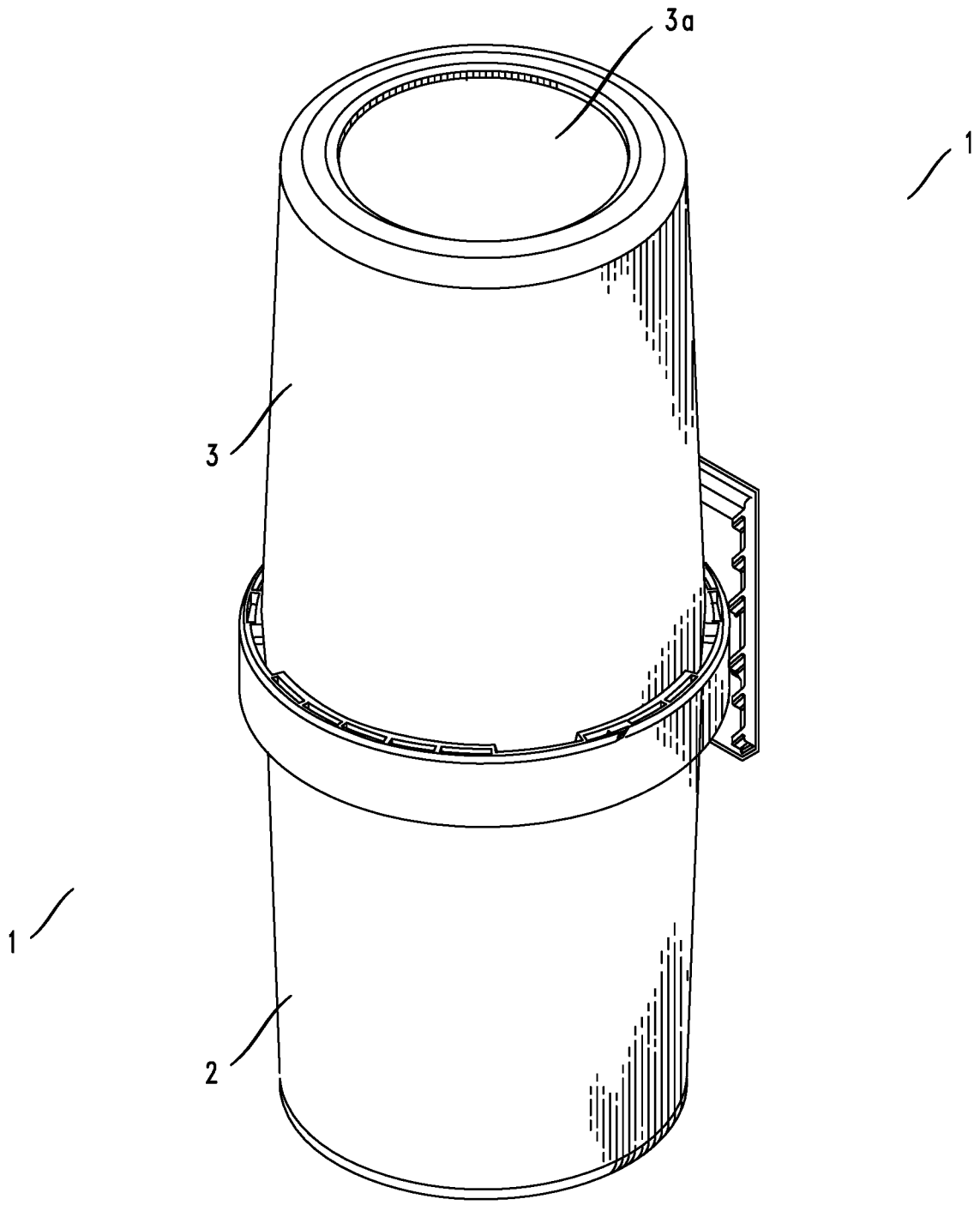
FIG. 1A depicts an exemplary inventive dispenser that includes an inventive mounting device according to an embodiment of the invention.

Exemplary embodiments of devices and related methods for mounting dispensers are described herein and are shown by way of example in the drawings. Throughout the following description and drawings, like reference numbers/characters refer to like elements or components.

It should be understood that although specific embodiments are discussed herein, the scope of the present disclosure is not limited to such embodiments. On the contrary, it should be understood that the embodiments discussed herein are for illustrative purposes, and that modified and alternative embodiments that otherwise fall within the scope of the disclosure are contemplated because it is impractical to describe herein with any degree of clarity each and every variation of the inventive ideas for mounting dispensers. For example, though the inventive devices and methods may be applicable to dispensers that dispense sanitary wipes, this is merely exemplary. Alternatively, the inventive devices and methods may be applicable to dispense a plurality of different wipes. Accordingly, as used herein the term "wipes" includes, but is not limited to, the following elements: sanitary wipes, antiseptic wipes, disposable wipes, cleaning wipes, disinfectant wipes, hand wipes, wet wipes and antibacterial wipes, where such wipes may be made from a plurality of different materials such as a cotton, bamboo, polyester, viscose/rayon, a wood pulp or a non-woven cloth material, for example, and may include, or be treated with, a cleaning, disinfecting, antiseptic, or antibacterial chemical or material, for example.

It should also be noted that one or more exemplary embodiments may be described as a process or method (the words "method" or "methodology" may be used interchangeably with the word "process" herein). Although a process/method may be described as sequential, it should be understood that such a process/method may be performed in parallel, concurrently or simultaneously. In addition, the order of each step within a process/method may be rearranged. A process/method may be terminated when completed, and may also include additional steps not included in a description of the process/method if, for example, such steps are known by those skilled in the art.

As used herein, the term "and/or" includes any and all combinations of one or more of the associated listed items. As used herein, the singular forms "a," "an" and "the" are intended to include the plural form, unless the context and/or common sense or knowledge of one skilled in the art indicates otherwise.

It should be understood that when an device, or a component or element of a device, is referred to, or shown in a figure, as being "connected" to (or other tenses of connected) another component or element of a device, such components or elements may be directly connected, or may use intervening components or elements to aid a connection. In the latter case, if the intervening components or elements are well known to those in the art then they may not be described herein or shown in the accompanying figures for the sake of clarity.

As used herein the term "configured to" and/or "operable to" means "functions to" unless the context, common sense or knowledge of one skilled in the art indicates otherwise.

It should be understood that when used herein, the designations "first", "second", "third" etc., are used to distinguish one component or element of a system or device or part of a process from another and do not indicate an importance, priority or status unless the context, common sense or recognized knowledge of those skilled in the art indicate otherwise. In fact, in some cases the component or elements of a device or steps in a process could be redesignated (i.e., re-numbered) and it would not affect the scope of the present invention.

It should be noted that the devices, as well as any components, or elements thereof, illustrated in the figures are not necessarily drawn to scale, and need not be representative of an actual shape or size and need not be representative of any actual device. Rather, devices, components and elements are drawn so as to help explain the features, functions and processes of various exemplary embodiments of the present invention described herein.

Relatedly, to the extent that any of the figures or text included herein depicts or describes dimensions, weights, forces or operating parameters it should be understood that such information is not meant to be limiting unless expressly stated, is merely exemplary and is provided to enable one skilled in the art to make and use an exemplary embodiment of the invention without departing from the scope of the invention.

As used herein, the terms "embodiment" and/or "exemplary" mean an example that falls within the scope of the invention(s).

The present invention provides inventive devices and related methods for mounting inventive dispensers.

Referring now to FIG. 1A there is depicted an inventive dispenser 1 according to one exemplary embodiment. Dispenser 1 may include a wipe chamber component 2, discard receptacle component 3, and a mounting device 4. One exemplary material composition of the components 2, 3 and mounting device 4 may be an opaque thermoplastic and amorphous polymer (e.g., an Acrylonitrile Butadiene Styrene (ABS) plastic).

In embodiments, the wipe chamber component 2 may be configured to receive, hold and dispense unused wipes while the discard receptacle component 3 may be configured to receive, hold and discard used wipes, for example. In an embodiment, the inventive mounting device 4 may be configured to at least fix the wipe chamber component 2 and the discard receptacle component 3 to a supporting structure (not shown in figure), such as a wall, stud or any one of a number of other, different structures or surfaces that are capable of supporting the weight of the dispenser 1 filled with unused wipes in component 2 and used wipes in component 3.

Figure 1B:
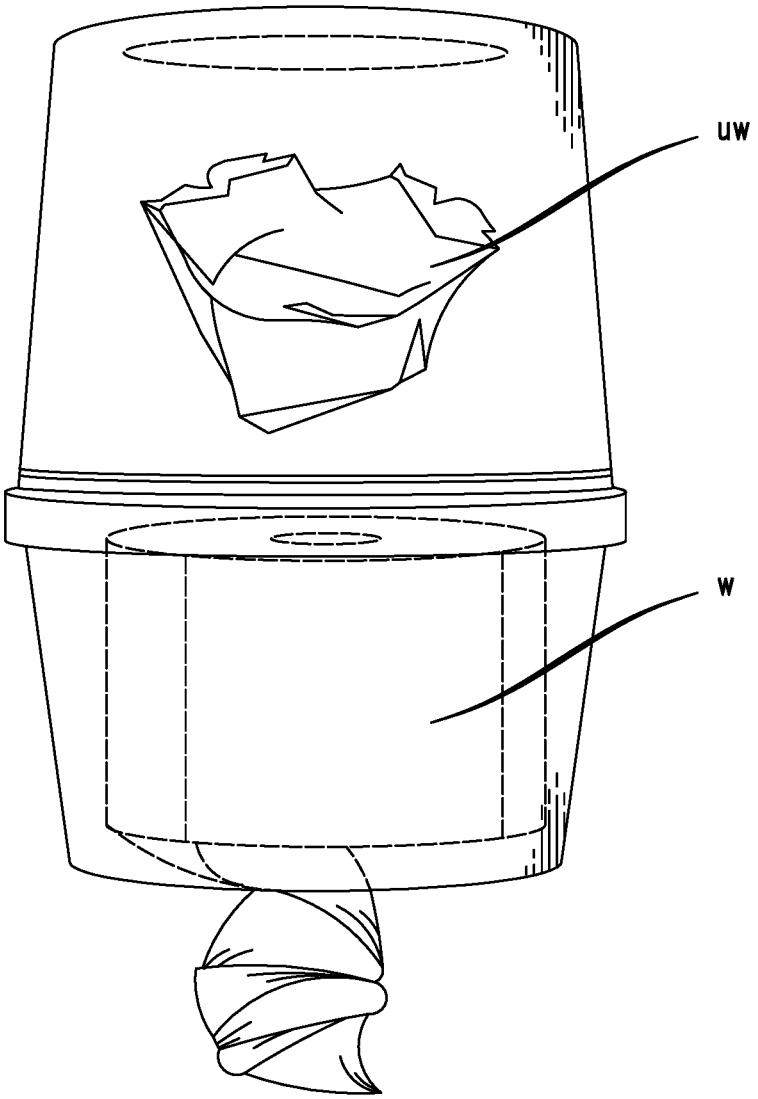
FIG. 1B illustrates the positioning of unused wipes and used wipes within a dispenser.

FIG. 1B illustrates the typical positioning of unused wipes (denoted by "W") and used wipes (denoted by "UW") within a dispenser for the reader's reference, it being understood that the dispenser shown does not illustrate the inventive mounting device nor does it illustrate many of the inventive features of an inventive dispenser—features that are described elsewhere herein. Accordingly, this figure is to be used to simply illustrate a typical, exemplary position of used and unused wipes.

Figure 1C:
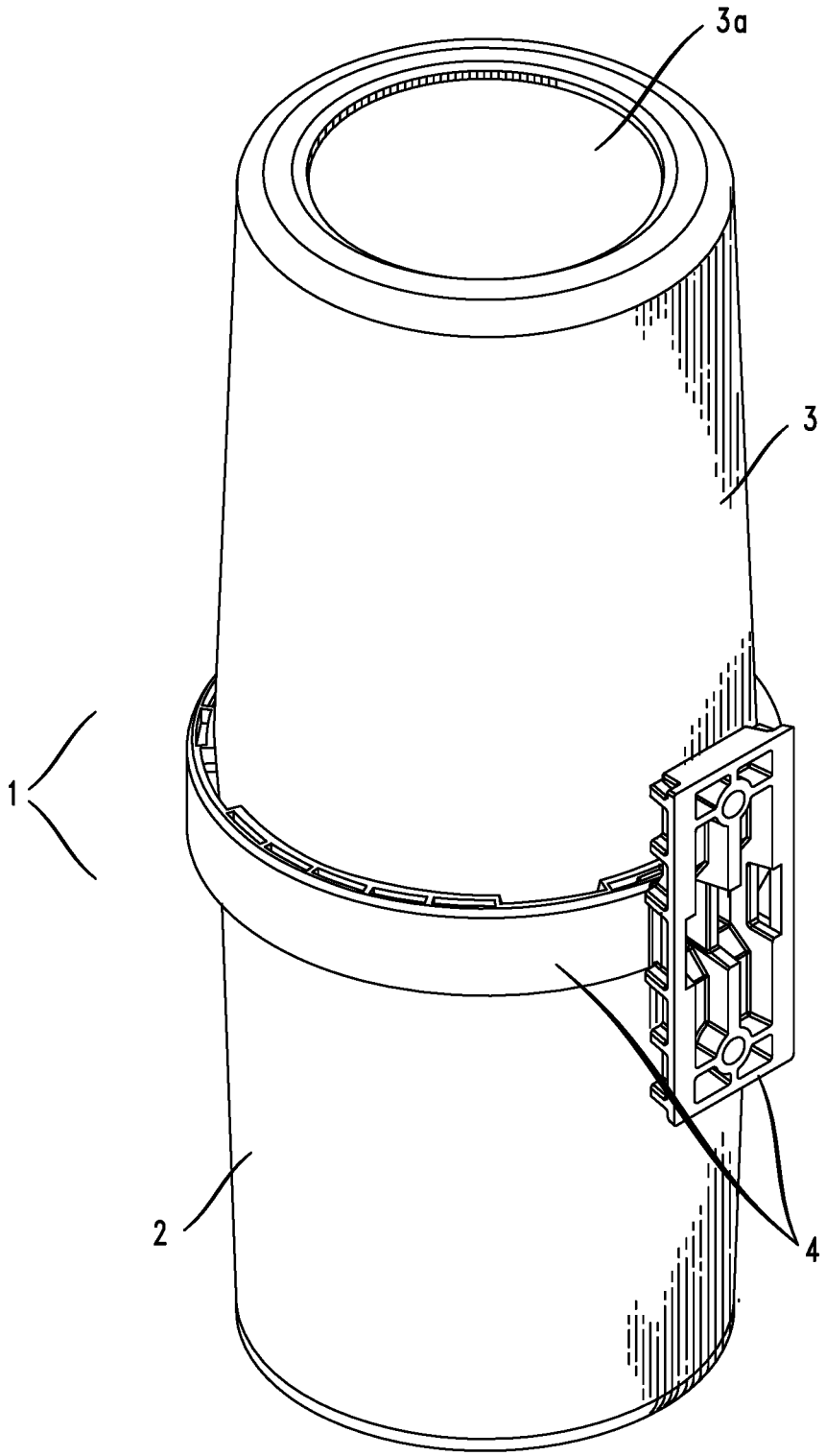
FIG. 1C depicts another view of the inventive dispenser and inventive mounting device shown in FIG. 1A according to an embodiment of the invention.

Referring now to FIG. 1C there is depicted another view of the inventive dispenser 1. As shown, the discard receptacle component 3 may comprise a first opening or aperture (collectively "aperture") 3*a* which may have a diameter that allows used wipes to be placed into the component 3 after they have been dispensed from component 2 and used. In an embodiment, when the dispenser 1 is positioned such that discard receptacle component 3 is vertically above the wipe chamber component 2, then the first aperture 3*a* may be considered to be positioned on the top of component 3. While a cover for covering first aperture 3*a* of component 3 is not shown, it should be understood that one may be provided to hide used wipes within component 3 from view and to prevent used wipes from being unintentionally discarded. Such a cover may be removable, hinged or otherwise connected to the component 3, for example.

In the figures the aperture 3*a* is illustrated as being circular or oval. This is merely exemplary. In an alternative embodiment, the aperture 3*a* may be funneled shaped, for example, to guide used wipes into the receptacle 3. In such an embodiment the aperture 3*a* may comprise a funnel shaped wall that protrudes into the component 3.

Figure 2A:
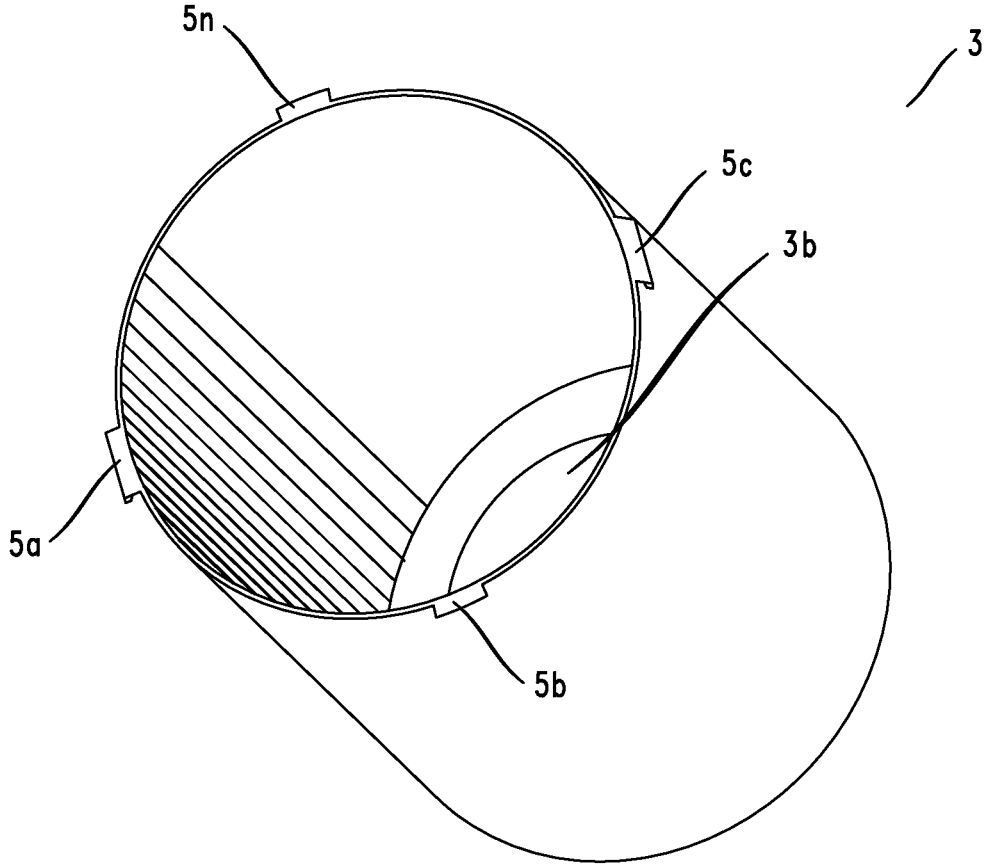
FIGS. 2A to 2E depict different views that include an inventive discard receptacle component of an exemplary dispenser according to embodiments of the invention.

In an embodiment, the discard receptacle component 3 may be configured with a second aperture 3*b* as shown in FIG. 2A which shows the component 3 upside down compared to its position in FIG. 1C. The second aperture 3*b* may be configured with a diameter that is larger than the first aperture 3*a*, thus the component 3 may be ornamentally tapered from top to bottom. Alternatively, the diameter of both apertures may be ornamentally the same, or, yet further, the ornamental diameter of the first aperture 3*a* may be larger than the ornamental diameter of the second aperture 3*b*. When the dispenser 1 is positioned such that discard receptacle component 3 is above the wipe chamber component 2, then the second aperture 3*b* may be considered to be positioned on the bottom of component 3.

Also shown in FIG. 2A are receptacle tabs 5*a* to 5*n* (where "n" represents the last tab) positioned around the perimeter of the component 3 that surrounds the aperture 3*b*, for example. In an embodiment, the tabs 5*a* to 5*n* may be formed integral with the component 3 using a mold, for example, or may be connected to component 3. In an embodiment, each of the tabs 5*a* to 5*n* may be configured to be rotatably and slidably fit or inserted into an opening, slot or groove (collectively groove) of the mounting device 4 to connect and hold the component 3 to the device 4 (see elements 4*a* to 4*n* in FIG. 2B). While four tabs 5*a* to 5*n* are shown in the figures, this is merely exemplary. More or less tabs may be included provided that the number of tabs provides a sufficient force to hold the component 3 to the device 4.

Figure 2B:
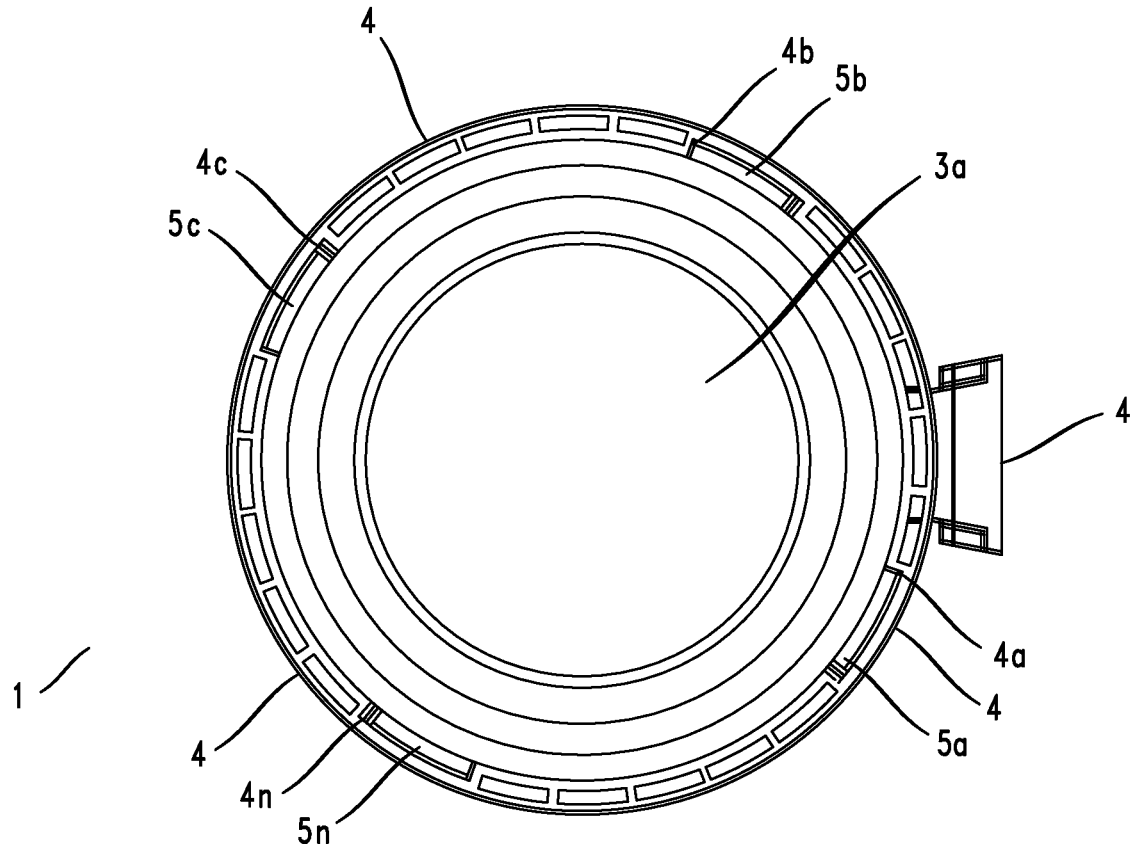
Figure 2C:
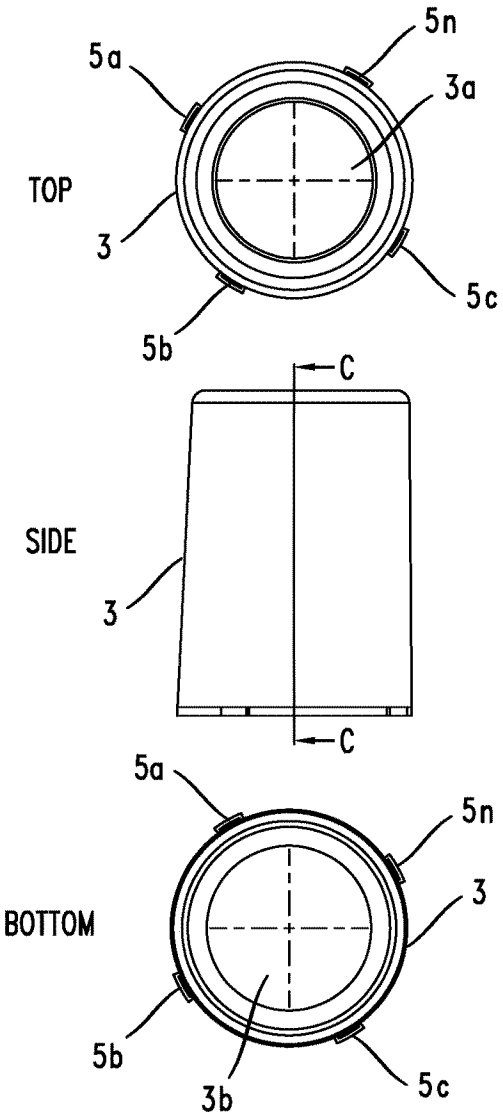
Figure 2D:
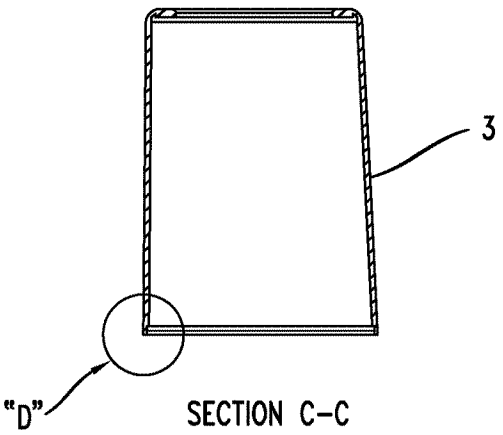
Figure 2E:
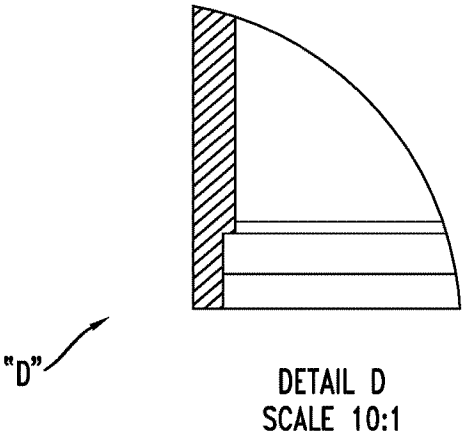

FIG. 2B depicts an enlarged bottom view of the dispenser 1 looking up and through aperture 3*a* of the discard receptacle component 3 and FIG. 2C depicts a top, side and bottom view of the component 3 itself. FIG. 2D depicts a sectional, side view (section "C-C") of the component 3, while FIG. 2E depicts a view of an overhang element of the component 3 that may be utilized when the aperture 3*a* is configured as a funnel shape, for example.

Figure 2F:
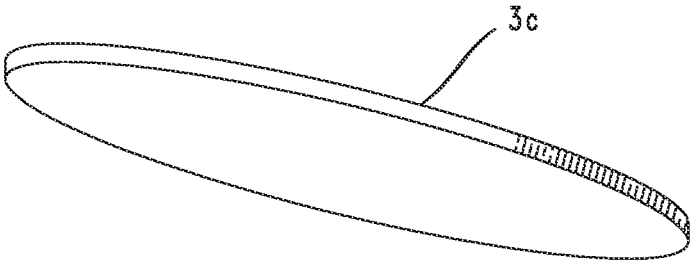
FIGS. 2F to 2G depict different views of a bottom cover for the inventive discard receptacle component in FIGS. 2A to 2E according to an embodiment of the invention.

In an embodiment, a bottom cover 3*c* configured to cover the second aperture 3*b* of component 3 is shown in FIG. 2F. The cover 3*c* may be operable to prevent used wipes that are received by, and held within, component 3 from escaping through aperture 3*b* and falling into the wipe chamber component 2. Though cover 3*c* is depicted as a separate, removable element, this is merely exemplary. Alternatively, cover 3*c* may be hingeably connected to component 3 or otherwise fixably connected to the component 3, for example.

Figure 2G:
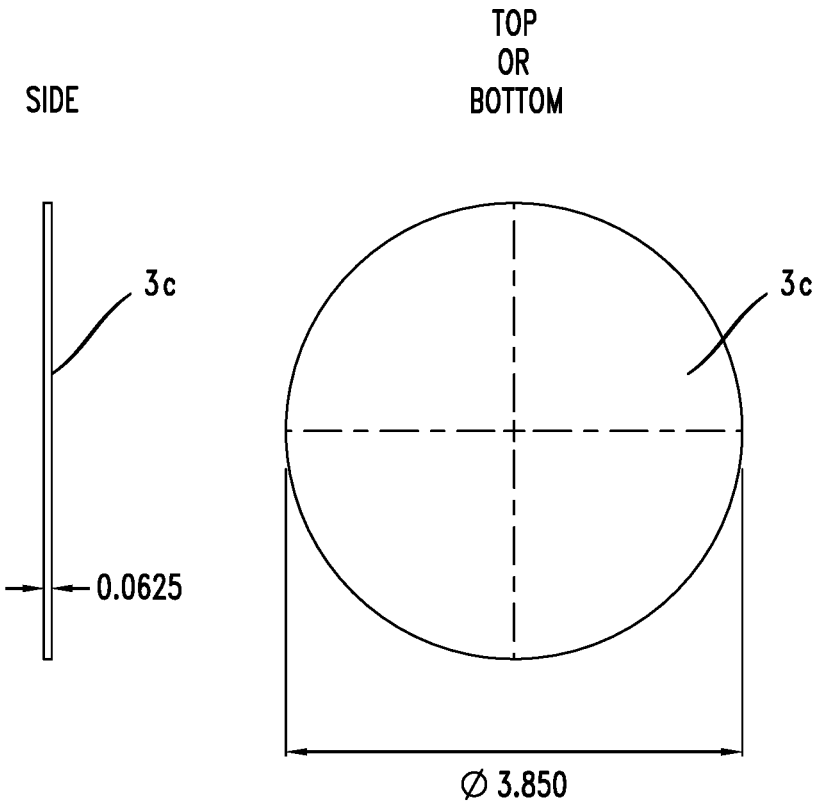

FIG. 2G depicts two additional views of the cover 3*c* (side and top/bottom views) along with some non-limiting, exemplary dimensions, it being understood that the dimensions are merely exemplary and may be varied, for example, as the diameter of opening 3*b* is varied for example.

Figure 3A:
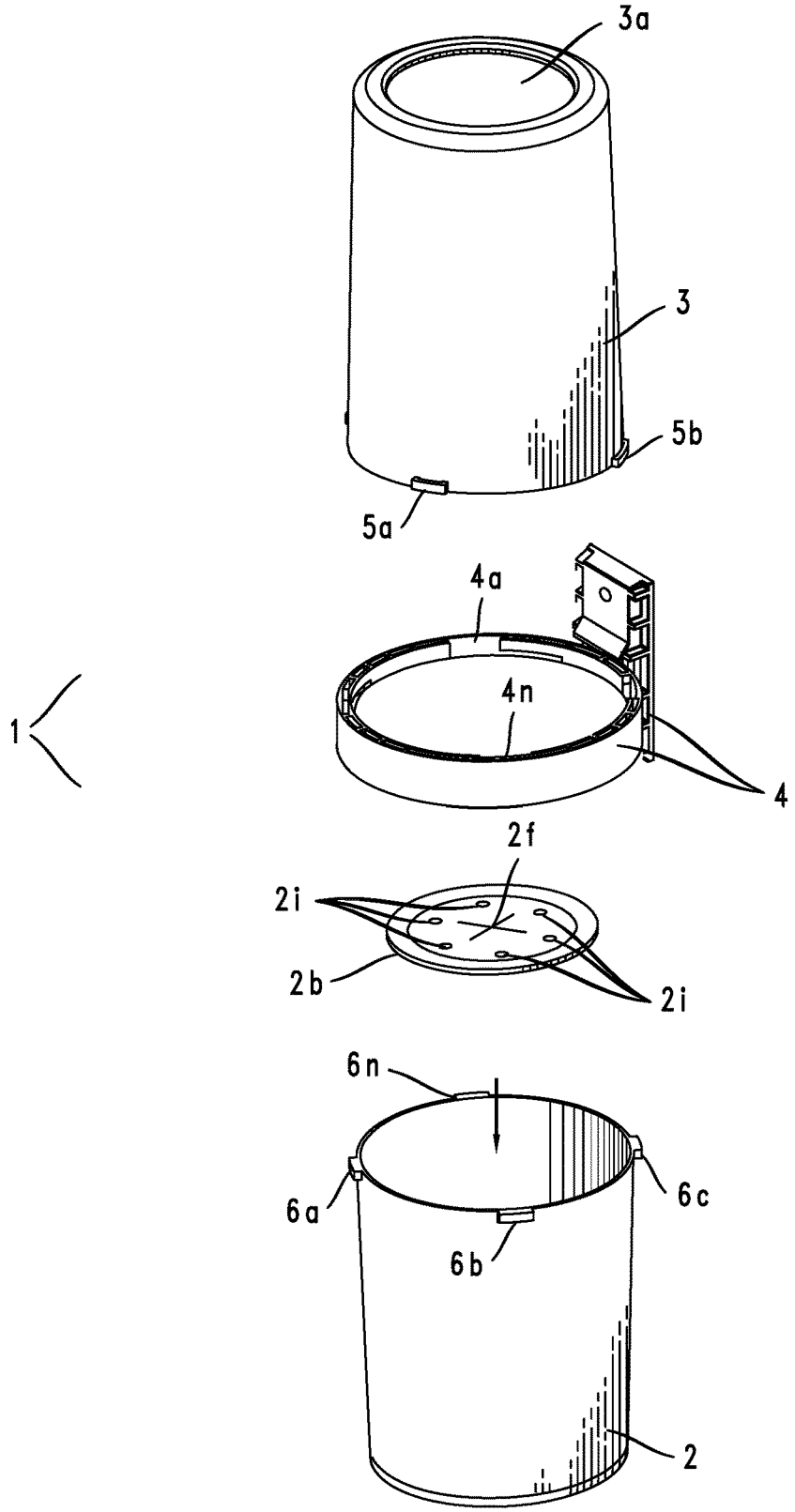
FIG. 3A depicts a first exploded view of a first, exemplary inventive dispenser that includes an inventive mounting device according to an embodiment of the invention.
Figure 3B:
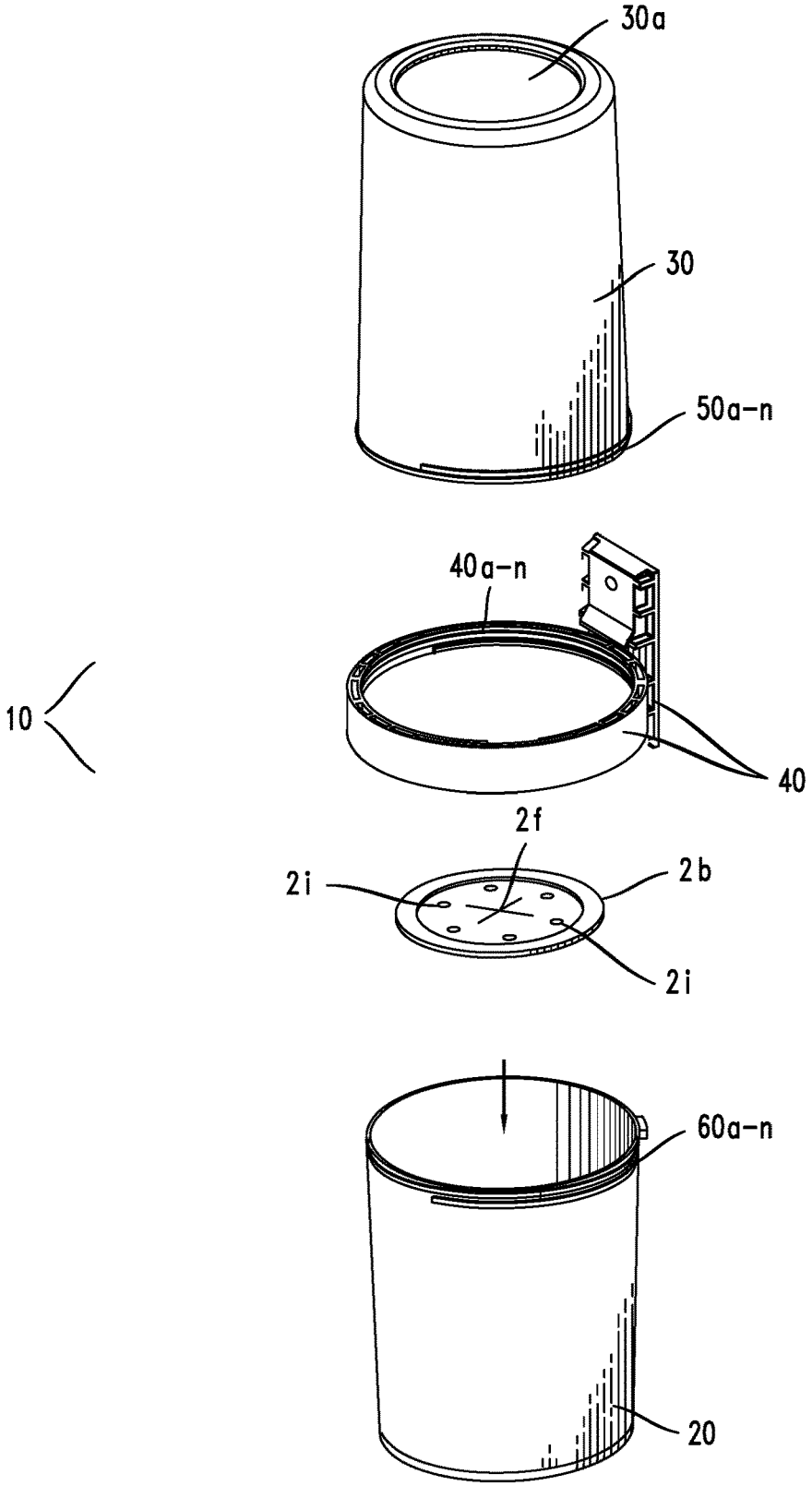
FIG. 3B depicts a second exploded view of an alternative, exemplary inventive dispenser that includes an alternative, inventive mounting device according to yet another embodiment of the invention.

Referring now to FIGS. 3A and 3B there is depicted the dispenser 1 (FIG. 3A) and an alternatively configured dispenser 10 (FIG. 3B). In FIG. 3A both the wipe chamber component 2 and discard receptacle component 3 comprise respective tabs 6*a* to 6*n*, and 5*a* to 5*n* (where again "n" represents the last tab) that may be integrally-formed with a respective component 2, 3 using a mold, for example, or may be connected to a respective component 2, 3. In an embodiment, each of the tabs 5*a* to 5*n*, 6*a* to 6*n* may be configured to be rotatably and slidably fit or inserted into an opening, slot or groove (collectively groove) 4*a* to 4*n* of the mounting device 4 to connect and hold the respective component 2, 3 to the device 4 (see also FIGS. 2B and 4B). Again, while each component 2, 3 is depicted having four tabs 5*a* to 5*n*, 6*a* to 6*n*, this is merely exemplary. More or less tabs may be included provided that the number of tabs provides a sufficient force to hold a respective component 2, 3 to the device 4.

Yet further, it should be understood that the tabs 5*a* to 5*n*, 6*a* to 6*n* of components 2, 3 may be slidably inserted into the top or bottom of the device 4. That is to say the device 4 may be turned upside down and still be configured to receive either component 2 or component 3 in its top or bottom.

In comparison, the alternatively configured, inventive dispenser 10 shown in FIG. 3B preferably does not use tabs. Instead, both the wipe chamber component 20 and discard receptacle component 30 may comprise respective one or more integral threads 60*a* to 60*n*, and 50*a* to 50*n*, respectively (e.g., at least one thread 60*n*,50*n* and preferably at least two threads 60*a*, 60*n*, 50*a*, 50*n*, where "n" represents the last thread). In an embodiment, each of the threads 50*a* to 50*n*, 60*a* to 60*n* may be configured to be threadably rotated into threads 40*a* to 40*n* of the alternatively configured mounting device 40 to connect and hold the respective component 20, 30 to the device 40, where it should be understood that the respective components 20, 30 are threadably connected to different threads 40*a* to 40*n* of the device 40 (e.g., component 30 is threadably connected to top threads 40*a* to 40*n* and component 20 is threadably connected to bottom threads 40*a* to 40*n* of the device 40. In embodiments, threads 40*a* to 40*n* may be threaded the same direction (e.g., clockwise).

FIGS. 3A and 3B also depict an exemplary, removable wipe chamber interface element 2*b* for, among other things, regulating the dispensing of unused wipes from chamber 2 or 20 as described elsewhere herein. In an embodiment, the element 2*b* may be composed of a thermoplastic elastomer material, for example. In an embodiment the element 2*b* may be positioned within the interior of the wipe chamber component 2 or 20 to cover the bottom surface 2*d* of component 2 (see FIG. 4A) or 20. In more detail, element 2*b* may comprise one or more notches or indentations 2*i*, each of which is configured around a perimeter of the element 2*b* and may be aligned with corresponding protrusions 2*ii* on a bottom surface 2*d* of component 2 (see FIG. 4F, bottom view) or 20. Upon being inserted into the component 2 or 20, each of the indentations 2*i* may be aligned over a corresponding protrusion 2*ii* on the interior of bottom surface 2*d* to fix the element 2*b* over the interior surface of the bottom surface 2*d* of component 2 (or 20) and to align the central frictional aperture 2*f* of element 2*b* with aperture 2*c* on the surface 2*d* to allow wipes to be dispensed from component 2 (or 20) as explained elsewhere herein.

Figure 4A:
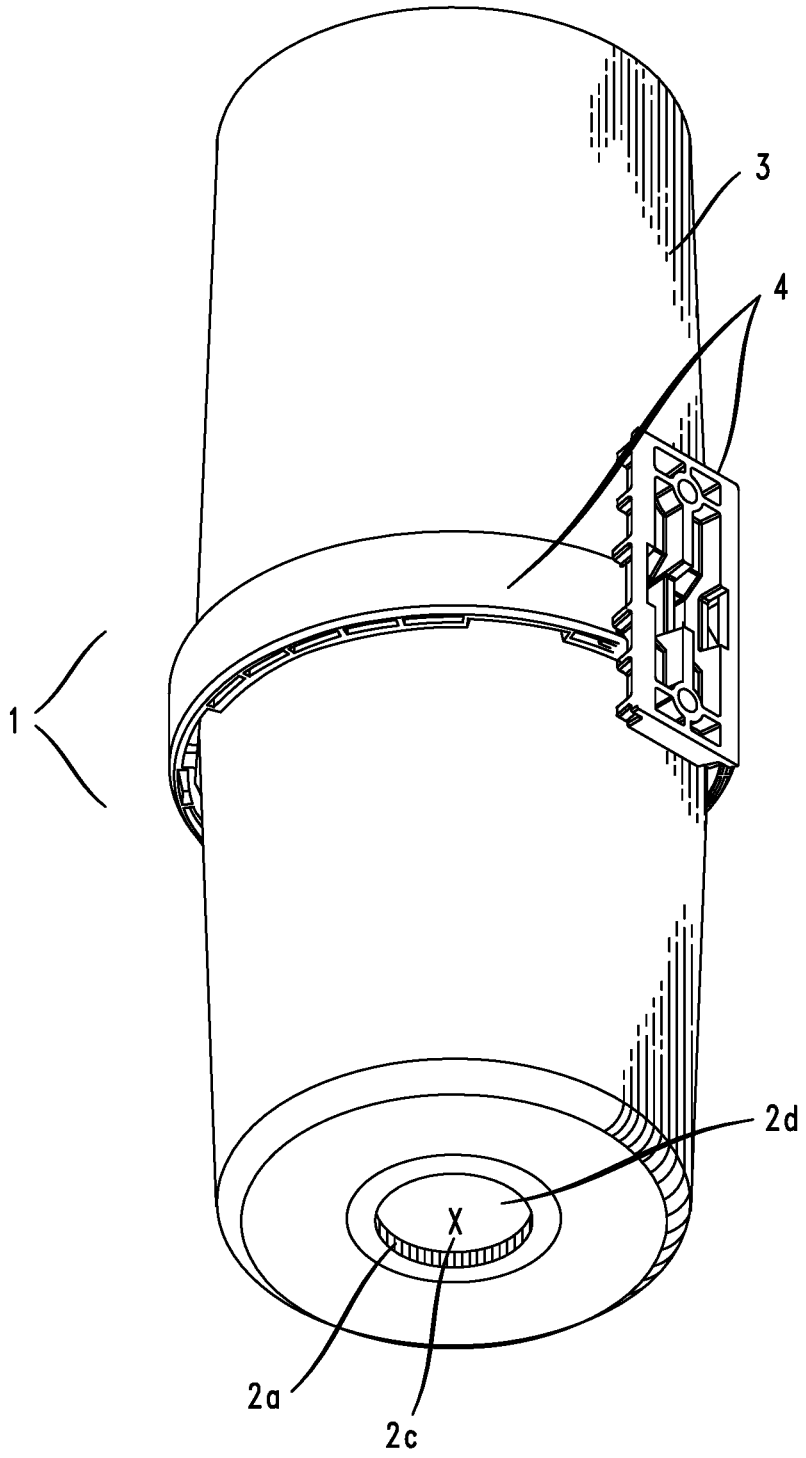
FIGS. 4A to 4H depict views of different views that include an inventive wipe chamber component of an exemplary dispenser according to an embodiment of the invention.

Referring now to FIG. 4A there is depicted a bottom view of the inventive dispenser 1. In this view the exemplary wipe chamber interface element 2*b* is not shown. Instead, in an embodiment, a first aperture 2*a* comprising an integral bottom surface 2*d* may have an aperture 2*c* for initially dispensing unused wipes from component 2. In an embodiment, the inventor discovered that when the component 2 is composed of a plastic and an aperture such as 2*c* is made in the surface 2*d* of the component 2 too much air may leak, or otherwise flow, into the chamber formed by component 2 from the exterior of the component 2 and, thereby inadvertently dry out a chemical, liquid or other material that is a part of an unused wipe, thus destroying the functionality of the wipe (e.g., the wipe is no longer effective at cleaning a user's hands). Accordingly, to restrict air flow into the chamber of the component 2 the inventor discovered that by positioning the removable wipe chamber interface element 2*b* with a corresponding central frictional aperture 2*f* aligned over the surface 2*d* (and with aperture 2*c*) such an element 2*b* substantially restricts air flow into the chamber of component 2 through the aperture 2*c* and thereby preserves the functionality of the unused wipes within the chamber (see FIGS. 4*c*, 4D and 4E).

Figure 4B:
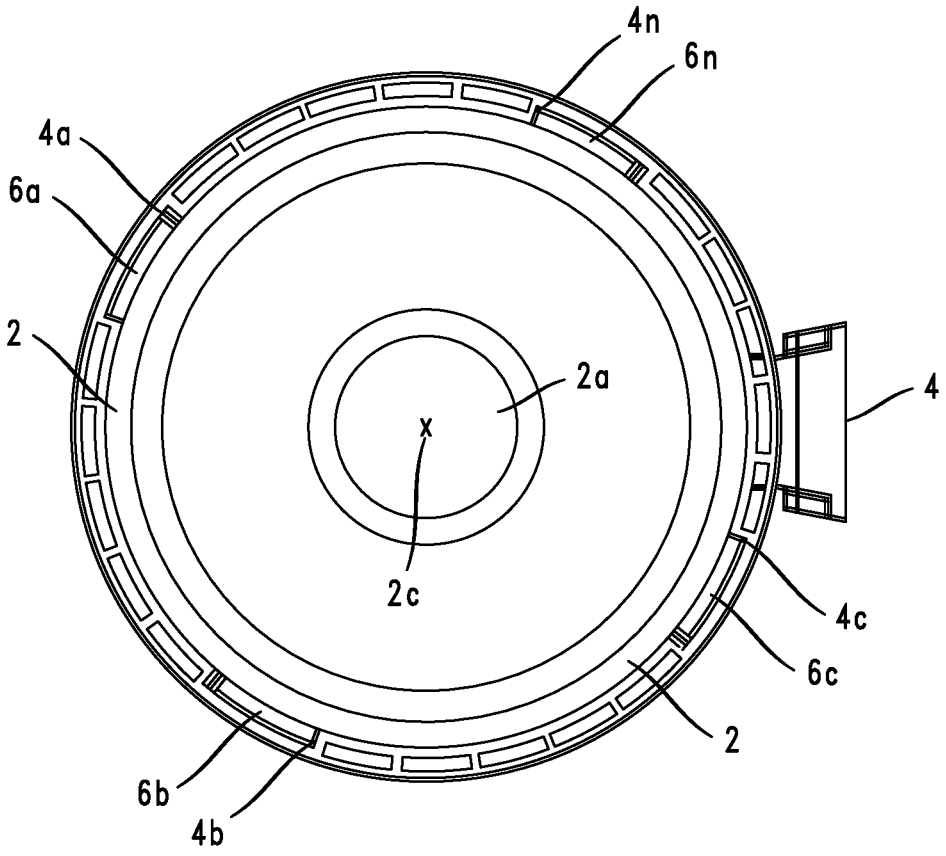

FIG. 4B depicts a view from the bottom of the dispenser 1 without the interface element 2*b* installed. As shown, the wipe chamber component 2 may comprise one or more tabs 6*a* to 6*n* (where again "n" represents the last tab) that may be integrally-formed with a component 2 using a mold, for example, or may be connected to component 2 and positioned around a perimeter of an aperture 2*h*, for example (see FIG. 4G for a view of apertures 2*a* and 2*h*).

In an embodiment, each of the tabs 6*a* to 6*n* may be configured to be rotatably and slidably fit or inserted into an opening, slot or groove (collectively groove) 4*a* to 4*n* of the mounting device 4 to connect and hold the respective component 2, 3 to the device 4 (see also FIGS. 2B and 4B).

Figure 4C:
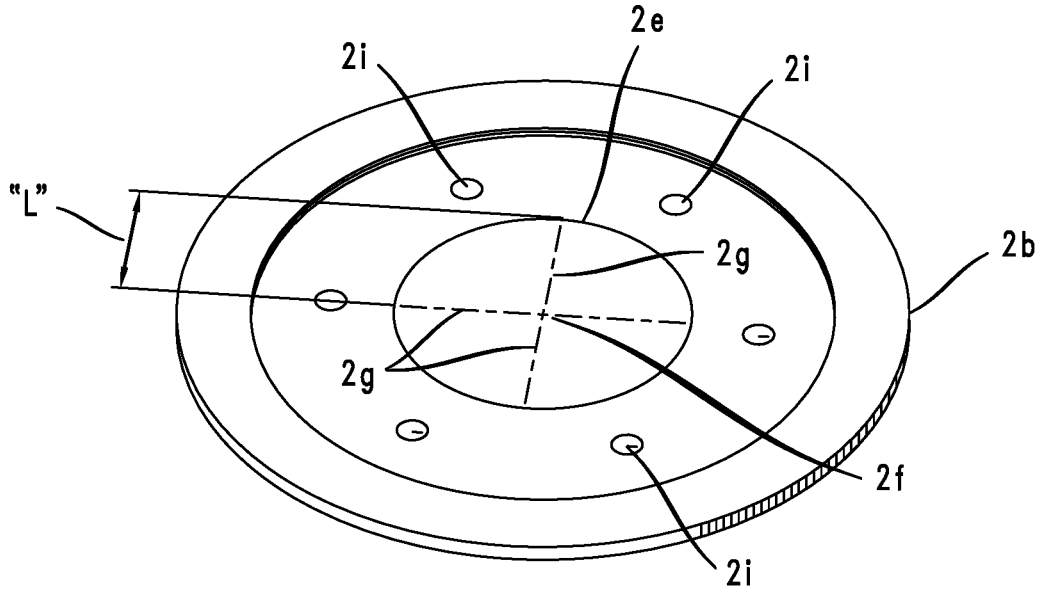

Referring now to FIG. 4C there is shown an enlarged view of an exemplary, removable wipe chamber interface element 2*b*. In this view it can be seen that the element 2*b* comprises a frictional aperture 2*e* that may comprise frictional edge openings 2*g* and a central frictional aperture 2*f* that may form an "+" shape, for example, to regulate the dispensing of unused wipes. A non-limiting, exemplary length "L" of one or more of the edge openings 2*g* may be 14.75 millimeters, for example. In an embodiment, the dimensions of the edges 2*g* and central aperture 2*f* may be selected to frictionally dispense an unused wipe or wipe section from unused wipes held within component 2 by withdrawing a wipe or wipe section through the apertures 2*f* (and internal aperture 2*c* which aperture 2*f* is aligned with) and forcing a surface of the withdrawn unused wipe or wipe section against an edge 2*g* to cut or otherwise separate a withdrawn wipe or wipe section from held unused wipes or wipe sections within the component 2 that may have been previously connected to the withdrawn wipe or wipe section.

Also shown are one or more notches or indentations 2*i*, each of which is configured around a perimeter of the element 2*b* and may be aligned with corresponding protrusions 2*ii* on a bottom surface 2*d* of component 2 (see FIG. 4F, bottom view) or 20 to fix the element 2*b* over the interior surface of the bottom surface 2*d* of component 2 (or 20) and to align the aperture 2*f* of element 2*b* with aperture 2*c* on the surface 2*d* to allow wipes to be dispensed from component 2 (or 20).

Optionally, the dispenser 1 (or 10) may comprise a pressure sensor (not shown in figures), LED photodetectors in combination with electronic transceivers or another type of sensor that is configured to detect the weight or level of unused wipes that remain within a wipe chamber component and generate an electrical signal that may be transmitted or sent to an indicator (e.g., a local or remote display) representing that the detected weight or level has fallen below an adjustable threshold thereby indicating that additional unused wipes may be need to be added to the component 2. Alternatively, such a sensor may comprise a mechanical sensor connected to a mechanical indicator that mechanically and visually indicates a level of unused wipes.

Figure 4D:
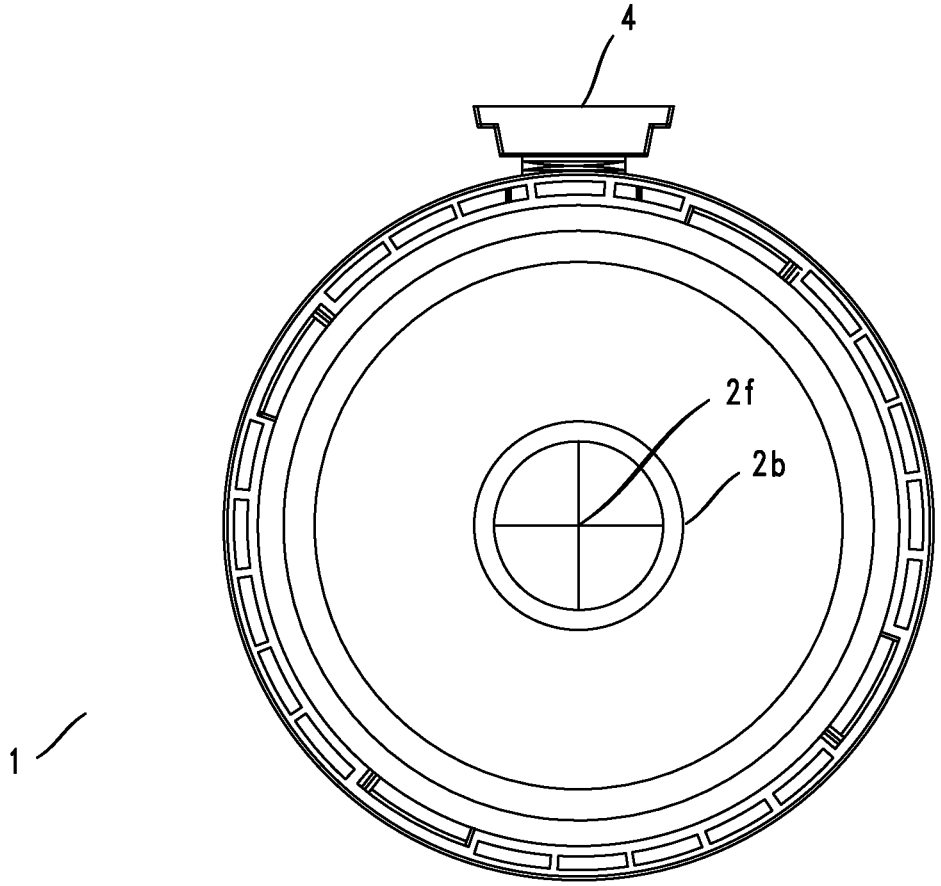

FIG. 4D illustrates a bottom view of the inventive dispenser 1 with the element 2*b* and its aperture 2*f* installed over the bottom surface 2*d* and its aperture 2*c* (not shown).

Figure 4E:
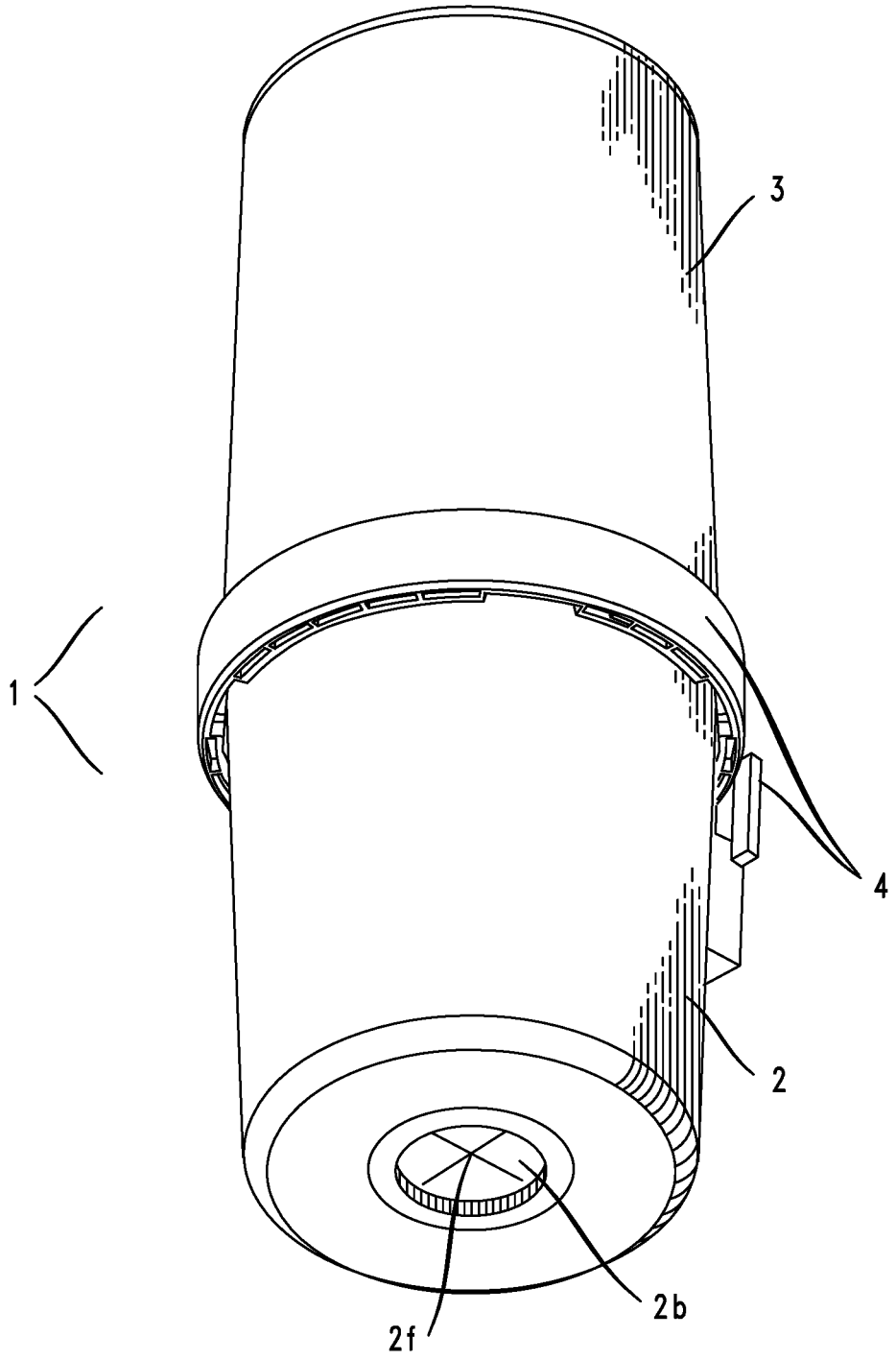
Figure 4G:
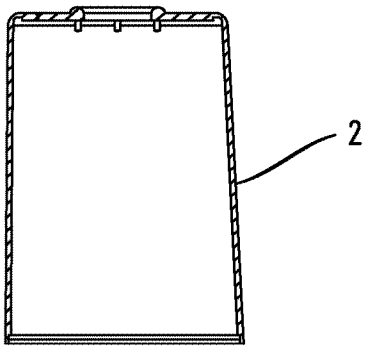
Figure 4F:
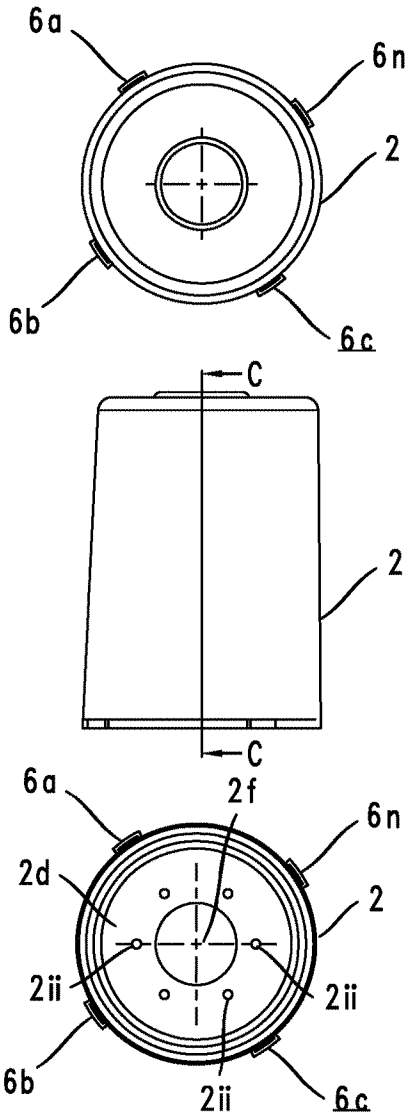

FIG. 4E depicts a perspective view of the dispenser 1, while FIG. 4F depicts a top, side and bottom view of the component 2 itself. FIG. 4G depicts a sectional, side view (section "C-C") of the component 2.

Figure 4H:
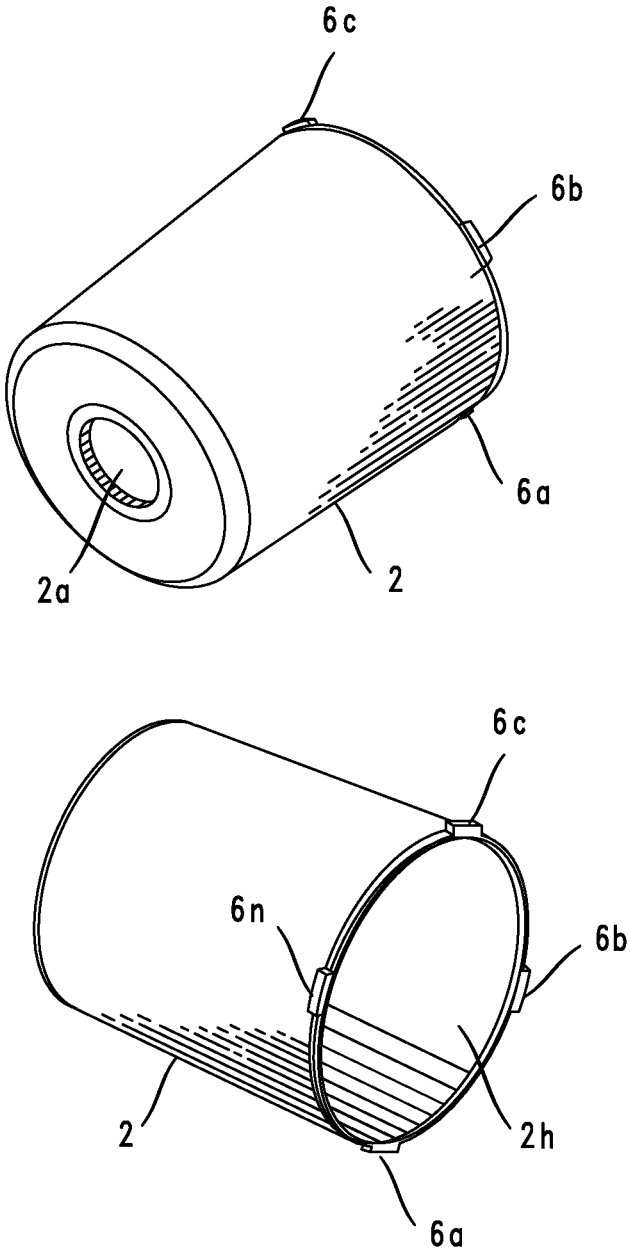

In an embodiment, the wipe chamber component 2 may be configured with a second aperture 2*h* as shown in FIG. 4H. The second aperture 2*h* may be configured with a diameter that is larger than the first aperture 2*a*, thus the component 2 may be ornamentally tapered from bottom to top. Alternatively, the diameter of both apertures may be the same, or, yet further, the diameter of the first aperture 2*a* may be larger than the diameter of the second aperture 2*h* When the dispenser 1 is positioned such that wipe chamber component 2 is below the discard receptacle component 3, then the second aperture 2*h* may be considered to be positioned on the top of component 2.

FIGS. 5A to 5F depict different views of the inventive mounting device 4 according to an embodiment of the invention.

Figure 5B:
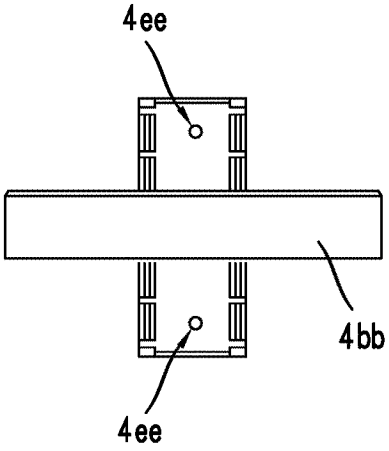
FIGS. 5A to 5F depict different views of an inventive mounting device according to an embodiment of the invention.
Figure 5C:
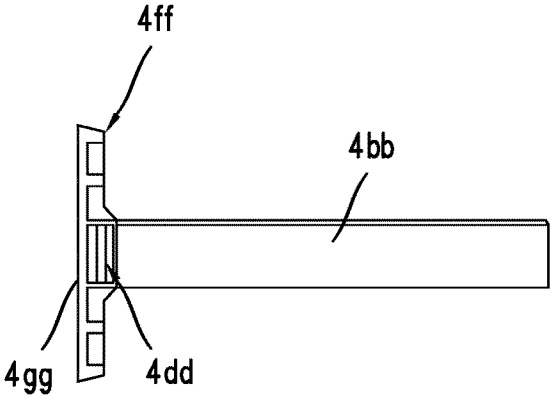
Figure 5A:
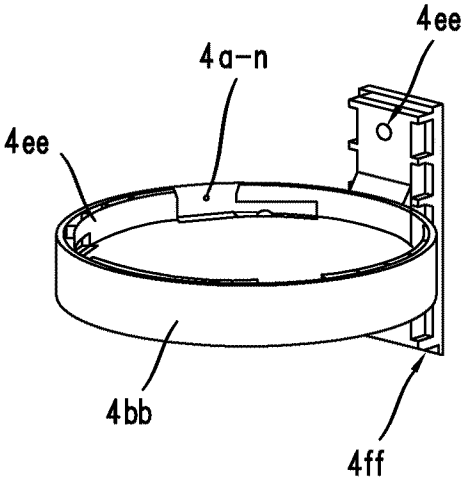
Figure 5E:
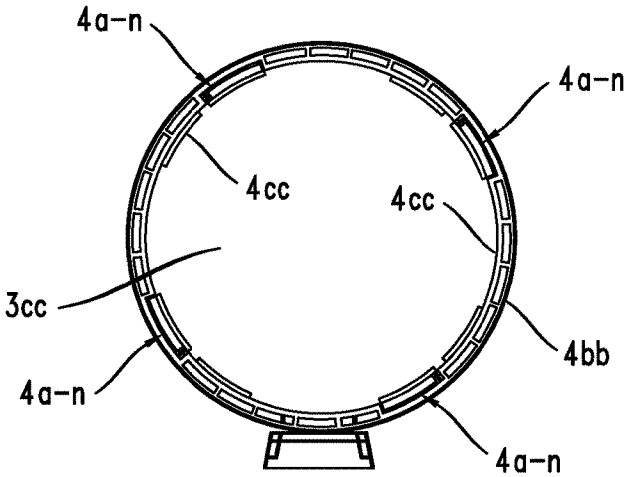
Figure 5F:
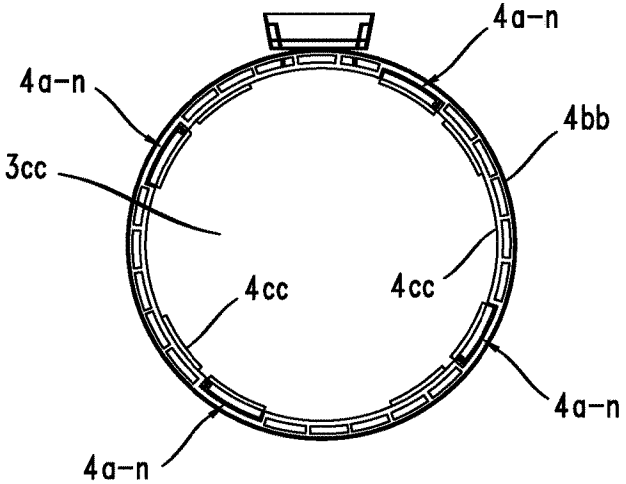

Referring first to FIGS. 5A and 5B there are depicted a perspective view (FIG. 5A) and front view (FIG. 5B) of an exemplary mounting device 4. In one embodiment, the device 4 may be configured to at least fix a wipe chamber component, such as chamber 2, and a discard receptacle component, such as component 3, for example, to a supporting structure (not shown in figure), such as a wall, stud or any one of a number of other, different structures or surfaces that are capable of supporting the weight of a dispenser such as dispenser 1, for example, filled with unused wipes. Though the mounting device 4 is described as being configured to support dispenser 1 it should be understood that this is merely exemplary. Alternatively, the device 4 may be configured to support variations of dispenser 1 (such as device 40 in FIG. 3B), for example. When both components 2,3 are connected to the device 4 it can be said that the components have been linkably connected together because the device 4 functions as link to connect the components 2,3.

FIGS. 5A to 5F illustrate that the mounting device 4 may comprise a curved element 4*bb* that may include one or more of the before-mentioned grooves 4*a* to 4*n*, where each groove may be located at a different position around an internal perimeter surface 4*cc* of the element 4*bb* and be configured to receive at least one of the tabs 5*a* to 5*n* of the discard receptacle component 3 and at least one of the tabs 6*a* to 6*n* of the wipe chamber component 2. In an embodiment, the curved element 4*bb* may be ornamentally shaped as a circular or oval ring, for example. In an embodiment, the ornamentally shaped mounting device may also comprise a bracket 4*ff* that is configured to be integrally molded to the curved element 4*bb* and functions to support at least the weight of curved element 4*bb*, component 3 filled with used wipes and component 2 filled with unused wipes.

In an embodiment, the cover 3*c* described elsewhere herein and shown in FIGS. 2E and 2F may be inserted or otherwise positioned on one side of the opening 3*cc* of the device 4 (see FIGS. 5E and 5F) and, when in use, over the second aperture 3*b* of component 3 to prevent used wipes that are received by, and held within, component 3 from escaping through opening 3*cc* and aperture 3*b* and then into component 2. It should be understood that the dimensions (e.g., diameter, perimeter) of the curved element 4*bb* may be varied, for example, as the outside diameter of a wipe chamber component and/or a discard receptacle component is varied.

The bracket 4*ff* may optionally comprise one or more openings 4*ee*, where each opening 4*ee* may be configured to receive a fastener (not shown), such as a bolt, screw or nail therethrough to allow the bracket 4*ff* to be secured and/or fixed to a supporting structure (not shown in figure), such as a wall, stud or any one of a number of other, different structures or surfaces that are capable of supporting the weight of a dispenser filled with unused wipes. Alternatively, bracket 4*ff* may comprise an adhesive surface or covering (not shown) that may be applied on a surface 4*gg* to fix the bracket 4*ff* to a supporting structure, for example (see FIGS. 5C and 5D).

Figure 5D:
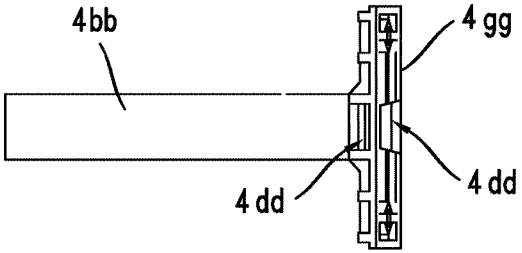

Referring to FIGS. 5C and 5D, the bracket 4*ff* may optionally comprise one or more slots 4*dd*, where each slot 4*dd* may be configured to receive a fastener therethrough, such as a cable or wire tie (not shown), which can then also be secured or fixed to a supporting surface to provide additional support for the dispenser filed with unused and used wipes (e.g., the ends that pass through a slot 4*dd* can be tied around a bar or pipe, for example).

Figure 6A:
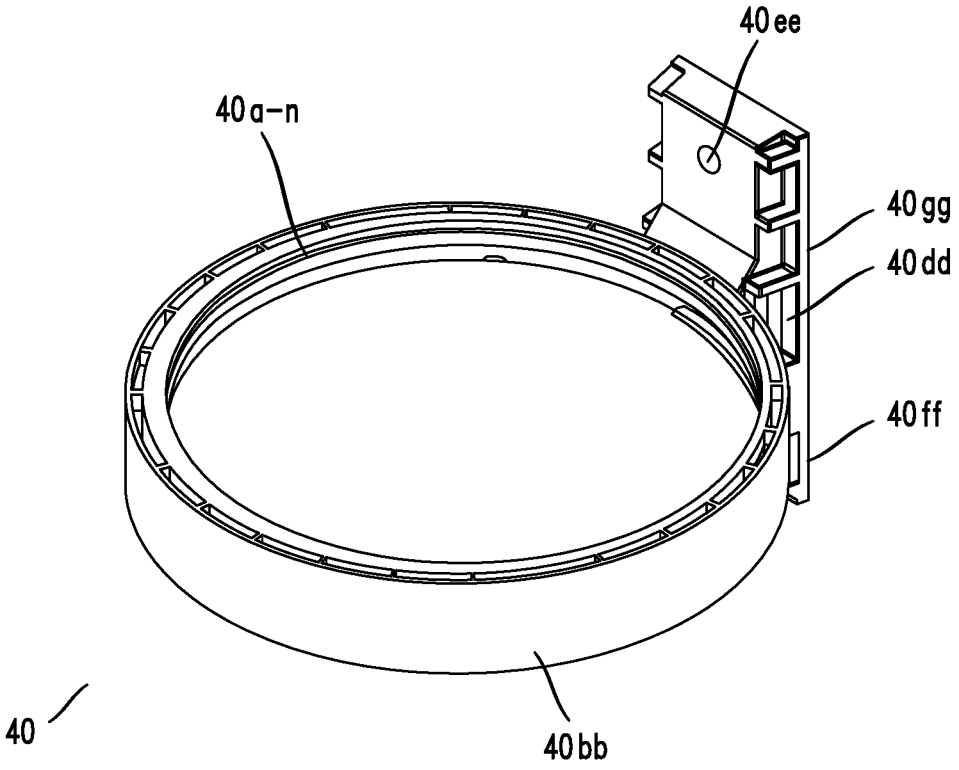

Referring now to FIG. 6A there are depicted a perspective view of an exemplary mounting device 40. In one embodiment, the device 40 may be configured to at least fix a wipe chamber component, such as chamber 20, and a discard receptacle component, such as component 30, for example, to a supporting structure (not shown in figure), such as a wall, stud or any one of a number of other, different structures or surfaces that are capable of supporting the weight of a dispenser such as dispenser 10, for example, filled with unused wipes. Though the mounting device 40 is described as being configured to support dispenser 10 it should be understood that this is merely exemplary. Alternatively, the device 40 may be configured to support variations of dispenser 10 (such as device 4 in FIG. 3A), for example. When both components 20,30 are connected to the device 40 it can be said that the components have been linkably connected together because the device 40 functions as link to connect the components 20,30.

FIGS. 6A (and 6B) illustrate that the mounting device 40 may comprise a curved element 40*bb* that may include one or more of the before-mentioned threads 40*a* to 40*n*, where each thread may be configured to receive threads 50*a* to 50*n* of the discard receptacle component 30 and threads 60*a* to 60*n* of the wipe chamber component 20. In an embodiment, the curved element 40*bb* may be ornamentally shaped as a circular or oval ring, for example. In an embodiment, the ornamentally shaped mounting device may also comprise a bracket 40*ff* that is configured to be integrally molded to the curved element 40*bb* and functions to support at least the weight of curved element 40*bb*, component 30 filled with used wipes and component 20 filled with unused wipes.

In an embodiment, the cover 3*c* described elsewhere herein and shown in FIGS. 2E and 2F may be inserted or otherwise positioned on one side of the opening 30*cc* of the device 40 and, when in use, over a second aperture of component 30 (not shown) to prevent used wipes that are received by, and held within, component 30 from escaping through opening 30*cc* and then into component 20. It should be understood that the dimensions (e.g., diameter, perimeter) of the curved element 40*bb* may be varied, for example, as the outside diameter of a wipe chamber component and/or a discard receptacle component is varied.

The bracket 40*ff* may optionally comprise one or more openings 40*ee*, where each opening 40*ee* may be configured to receive a fastener (not shown), such as a bolt, screw or nail therethrough to allow the bracket 40*ff* to be secured and/or fixed to a supporting structure (not shown in figure), such as a wall, stud or any one of a number of other, different structures or surfaces that are capable of supporting the weight of a dispenser filled with unused wipes. Alternatively, bracket 40*ff* may comprise an adhesive surface or covering (not shown) that may be applied on a surface 40*gg* to fix the bracket 40*ff* to a supporting structure, for example.

Still further, the bracket 40*ff* may optionally comprise one or more slots 40*dd*, where each slot 40*dd* may be configured to receive a fastener therethrough, such as a cable or wire tie (not shown), which can then also be secured or fixed to a supporting surface to provide additional support for the dispenser filed with unused and used wipes (e.g., the ends that pass through a slot 40*dd* can be tied around a bar or pipe, for example).

It should be understood that the foregoing description only describes a few of the many possible embodiments that fall within the scope of the inventions. Numerous changes and modifications to the embodiments disclosed herein may be made without departing from the general spirit of the invention, the scope of which is best defined by the claims that follow.

The invention claimed is:

1. A dispenser comprising:

a wipe chamber component configured to receive, hold and dispense unused wipes and further configured below a discard receptacle component;

the discard receptacle component configured to receive, hold and discard used wipes, wherein the wipe chamber component and the discard receptacle component comprise respective one or more integral threads, where each of the respective threads are configured to be threadably rotated into threads of a ring-shaped mounting device comprising a plurality of top internal receiving grooves for attaching the threads of the discard receptacle and a plurality of bottom internal receiving grooves for attaching the threads of the wipe chamber component to connect and hold the respective component to the mounting device; and wherein the mounting device is configured to at least fix the wipe chamber component below the discard receptacle component and is further configured to fix the wipe chamber component and the discard receptacle component to a supporting structure to support the weight of the wipe chamber component filled with the unused wipes and the discard receptacle component containing the used wipes, the supporting structure comprising a bracket extending from an outer surface of the ring shaped mounting device for attachment to a surface.

2. The dispenser as in claim 1 wherein the wipe chamber component, discard receptacle component and mounting device comprise an opaque thermoplastic.

3. The dispenser as in claim 1 wherein the discard receptacle component comprises a first aperture having an opening comprising a diameter allowing the used wipes to be placed into the discard receptacle component.

4. The dispenser as in claim 3 wherein the opening comprises a circle to allow the used wipes to be placed into the discard receptacle component.

5. The dispenser as in claim 1 wherein the discard receptacle component comprises tabs positioned around the perimeter of the discard receptacle component, each of the tabs configured to be rotatably and slidably fit or inserted into one or more the top internal receiving grooves of the mounting device to further connect and hold the discard receptacle component to the mounting device.

6. The dispenser as in claim 1 further comprising a removable cover configured to cover a second aperture of the discard receptacle component to prevent used wipes from falling into the wipe chamber component.

7. The dispenser as in claim 1 wherein the wipe chamber component comprises tabs configured to be rotatably and slidably fit or inserted into one or more the bottom internal receiving grooves of the mounting device to further connect and hold the wipe chamber component to the mounting device.

8. The dispenser as in claim 3 wherein the opening comprises an oval to allow the used wipes to be placed into the discard receptacle component.

9. The dispenser as in claim 1 wherein the wipe chamber component comprises a removable wipe chamber interface element for regulating the dispensing of unused wipes from the wipe chamber.

10. The dispenser as in claim 9 wherein the removable wipe chamber interface element is composed of a thermoplastic elastomer material.

11. The dispenser as in claim 9 wherein the removable wipe chamber interface element comprises a frictional aperture comprising frictional edge openings and a central frictional aperture to regulate the dispensing of unused wipes.

12. The dispenser as in claim 11 wherein the frictional aperture forms a "+" shape.

13. The dispenser as in claim 11 wherein the dimensions of the frictional edge openings and central aperture are selected to frictionally dispense an unused wipe or wipe section from unused wipes held within the wipe chamber component.

14. The dispenser as in claim 10 wherein the removable wipe chamber interface element comprises one or more indentations, each of which is configured around a perimeter of the wipe chamber interface element and aligned with corresponding protrusions on an interior of a bottom surface of the wipe chamber component to fix the wipe chamber interface element over the interior of the bottom surface and to align a central frictional aperture of the wipe chamber interface element with an aperture on the bottom surface to allow wipes to be dispensed from the wipe chamber component.

15. The dispenser as in claim 3 wherein the opening comprises a funnel-shaped aperture to allow the used wipes to be placed into the discard receptacle component.

16. A ring-shaped mounting device for a dispenser configured to at least fix a wipe chamber component configured to receive, hold and dispense unused wipes below a discard receptacle component and is further configured to fix the wipe chamber component and the discard receptacle component of the dispenser to a supporting structure, the mounting device comprising:

a plurality of top internal receiving grooves for attaching threads of the discard receptacle and a plurality of bottom internal receiving grooves for attaching threads of the wipe chamber component, where each groove is located at a different position around an internal perimeter surface of the ring-shaped mounting device; and a bracket configured to be integrally molded to the ring-shaped mounting device to support at least the weight of the ring-shaped mounting device, the wipe chamber component filled with unused wipes and the discard receptacle component filled with used wipes, the bracket extending from the outer surface of the ring shaped mounting device for attachment to a surface.

17. The mounting device as in claim 16 wherein the bracket comprises one or more openings, each opening configured to receive a fastener therethrough to allow the bracket to be secured and/or fixed to the supporting structure.

18. The mounting device as in claim 16 wherein the bracket comprises an adhesive surface or covering to fix the bracket to the supporting structure.

19. The mounting device as in claim 16 wherein the bracket comprises one or more slots, each slot configured to receive a fastener therethrough.

20. A dispenser comprising:

a wipe chamber component configured to receive, hold and dispense unused wipes and further configured below a discard receptacle component;

a discard receptacle component configured to receive, hold and discard used wipes; and a ring-shaped mounting device configured to at least fix the wipe chamber component below the discard receptacle component and is further configured to fix the wipe chamber component and the discard receptacle component to a supporting structure to support the weight of the wipe chamber component filled with the unused wipes and the discard receptacle component containing the used wipes, and further configured to connect the wipe chamber component and discard receptacle component, wherein the mounting device comprises a plurality of top internal receiving grooves for threadably attaching the discard receptacle and a plurality of bottom internal receiving grooves for threadably attaching the wipe chamber component where each groove is located at a different position around an internal perimeter surface of the mounting device wherein the supporting structure comprises a bracket extending from an outer surface of the ring shaped mounting device for attachment to a surface.

21. The dispenser as in claim 20 wherein the bracket comprises one or more openings, each opening configured to receive a fastener therethrough to allow the bracket to be secured and/or fixed to the supporting structure.

22. The dispenser as in claim 20 wherein the bracket comprises an adhesive surface or covering to fix the bracket to the supporting structure.

23. The dispenser as in claim 20 wherein the bracket comprises one or more slots, each slot configured to receive a fastener therethrough.

* * * * *